US008480814B1

(12) United States Patent
Fanourgiakis et al.

(10) Patent No.: US 8,480,814 B1
(45) Date of Patent: Jul. 9, 2013

(54) METHOD OF CLEANING A SHOPPING CART

(76) Inventors: John Dimitrios Fanourgiakis, Millbrae, CA (US); Nicholaos Dimitrios Fanourgiakis, Foster City, CA (US); Manoli Dimitrios Fanourgiakis, Foster City, CA (US); George Dimitrios Fanourgiakis, Foster City, CA (US)

( * ) Notice: Subject to any disclaimer, the term of this patent is extended or adjusted under 35 U.S.C. 154(b) by 0 days.

(21) Appl. No.: 13/199,087

(22) Filed: Aug. 17, 2011

Related U.S. Application Data

(62) Division of application No. 12/384,376, filed on Apr. 2, 2009.

(51) Int. Cl.
*B08B 3/00* (2006.01)
*B08B 3/08* (2006.01)

(52) U.S. Cl.
USPC ..... 134/26; 134/29; 134/34; 134/36

(58) Field of Classification Search
USPC ..... 134/26, 29, 30, 34, 36
See application file for complete search history.

(56) References Cited

U.S. PATENT DOCUMENTS

| | | | | |
|---|---|---|---|---|
| 3,179,117 | A | 4/1965 | Gibson et al. | |
| 3,444,867 | A | 5/1969 | Thornton | |
| 3,698,029 | A | 10/1972 | Pulliam | |
| 4,807,319 | A * | 2/1989 | Poitevin | 15/88.3 |
| 4,976,137 | A | 12/1990 | Decker et al. | |
| 5,265,628 | A | 11/1993 | Sage et al. | |
| 5,503,735 | A | 4/1996 | Vinas et al. | |
| 5,622,196 | A * | 4/1997 | Luongo | 134/72 |
| 2004/0031507 | A1 | 2/2004 | Ross et al. | |
| 2006/0107486 | A1 * | 5/2006 | Andre | 15/302 |
| 2007/0272279 | A1 * | 11/2007 | Foster | 134/32 |
| 2008/0178412 | A1 * | 7/2008 | Kiter | 15/309.2 |
| 2008/0190460 | A1 | 8/2008 | Berklund et al. | |
| 2008/0210268 | A1 * | 9/2008 | Metheny et al. | 134/95.2 |

* cited by examiner

*Primary Examiner* — Saeed T Chaudhry

(74) *Attorney, Agent, or Firm* — Kilpatrick Townsend & Stockton LLP

(57) ABSTRACT

A method for cleaning a shopping cart includes urging the shopping cart up a ramp and into an interior of a wash chamber of a shopping cart cleaner. A main door leading into said interior of the wash chamber may be closed. A cleaning mode of the shopping cart cleaner may be selected from either an automatic cleaning mode or a manual cleaning mode. A sump that is disposed at a bottom of the wash chamber may be filled with a quantity of water. The shopping cart may be washed with the water and a wash detergent. The shopping cart may be rinsed with the water and a rinse chemical. The water may be drained from the sump. The main door may be opened. The shopping cart may be removed from the wash chamber.

6 Claims, 16 Drawing Sheets

METHOD OF CLEANING A SHOPPING CART

This Divisional patent application is a continuation of currently co-pending patent application Ser. No. 12/384,376 filed Apr. 2, 2009, entitled "Cart Washer," by the same inventors, John Dimitrios Fanourgiakis, et al. Accordingly, this Divisional patent application thereby claims the benefit of the date of priority of parent patent application Ser. No. 12/384,376 of Apr. 2, 2009.

BACKGROUND OF THE INVENTION

1. Field of the Invention

The present invention, in general, relates to shopping carts and, more particularly, to a system for washing shopping carts.

Shopping carts are used for the placement and transport of merchandise that is to be purchased. Shopping carts are commonly used in grocery stores (i.e., supermarkets), department stores, and various other types of business establishments. It has been scientifically shown that shopping carts accumulate substantial concentrations of germs, viruses, and other disease agents that can spread infection amongst those who use the shopping carts by transference through touch.

Certain of the business establishments have provided a variety of attempted solutions to avert the spread of disease which include providing wipes and disinfectants for use, but these are largely overlooked and impractical. Customers would, instead, prefer to use a cart that they know is clean. This has created a need for washing carts.

There are no known cart washers that are comparable to the instant invention. Attempts to modify existing washing machines such as those designed to clean wheelchairs have had limited success and include many disadvantages, deficits, problems, or shortcomings. While representative of the current state of the prior art, such types of washing machines are intended to solve a different purpose and therefore, includes structures not especially well suited for washing shopping carts.

For example, a shorter wash time is needed than is currently available. This is because many stores have hundreds of shopping carts and if an excessive amount time is required to wash each cart, including the time to put the cart in the machine, wash it, and remove it from the machine then the labor investment will be too high to be practicable.

Certain prior art designs include a plumbing conduit on the floor which makes passage of wheels, such as are found on a bottom of the cart, over the conduit difficult to accomplish. This also causes a lower portion of any cart placed therein to be disposed directly in a sump containing the fluid. This is not desirable for numerous reasons. Also, a lip proximate a ramp and entry door of certain prior art cleaning machines makes passage of the cart over the lip difficult to accomplish.

Certain prior art designs include a design that precludes UL approval of the entire machine. The main pump of certain prior designs heats excessively if a door proximate the main pump is closed and the pump is operated for an extended period of time.

Certain prior art machines require at least five gallons of water and if less water is attempted to be used, the sump may be sucked empty during use which would result in a loss of prime.

Certain of the prior art designs require the opening of a side door on a sidewall to replenish or change any of the wash or rinse chemicals which precludes placement of the device against a wall that would obstruct opening of the side door or access to an interior.

Additionally and of special importance, all known prior art types of washing machines that include one or more automatic cycle settings do not also include a manual setting. This is because all prior art washing machines teach away from including a manual mode capability along with one or more automatic washing cycles. This is because of the possibility to overfill or otherwise misuse the washing machine when switching from an automatic setting (perhaps in mid-cycle) to a manual setting or because of the possibility to overfill or otherwise misuse the washing machine when the machine is in the manual mode.

However, there is a need to be able to provide an automatic setting for routine cleaning and to also provide manual cleaning capability to optimally tailor operation when cleaning carts that are exceptionally dirty or clean.

To better illustrate the teaching away of prior art, consider that a home laundry washing machine that includes several automatic cycles from which to choose does not, also, include manual capability whereby the user can repeatedly press a "fill button" to fill the laundry washing machine with water (or control any of the other functions) because of the very real risk that the laundry washing machine could be filled beyond overflowing.

Another prior art approach to solving the problem of cart contamination is to provide an open shell for the placement of a shopping cart therein and to spray a disinfectant or sanitizing agent on the cart via three or four nozzles that are provided. However, this approach is unsatisfactory because the moment the "sanitized" cart is removed from the cleaning station by store personnel it is no longer sanitized as a result of contact by the store personnel. Additionally, any agent that is sprayed on the cart tends to accumulate in layers, which is undesirable. The agent may cake or get sudsy, especially if the cart is exposed to rain or mist. Customers do not appreciate caking (i.e., layering) of material on the cart or any occurrence of suds on the cart. Additionally, the floors can become slippery due to the suds created by the agent. This can occur where the carts are sprayed and also where the carts are stored or used. In particular, there is the possibility that the floors in the stores, themselves, can become slippery as a result of using this type of a system. This creates a liability for the stores.

Accordingly, there exists today a need for a cart washer that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

Clearly, such a cart cleaning machine or system would be especially useful and desirable.

2. Description of Prior Art

Shopping carts are, in general, known as are machines for washing commercial products. However, a cart washer comparable to the instant invention is not known. The only known distally related prior art device is a wheelchair washing machine that is made by Medco Equipment, however it does not anticipate the instant novel structures or the benefits derived, therefrom.

A prior art device that is sold by "Pure Cart Systems" does not wash a shopping cart but instead is used to spray a disinfectant or a sanitizing agent on the cart.

While the structural arrangements of the above described device and other washing machines devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a cart washer that includes a regular cleaning cycle of approximately 20 seconds per cart.

It is also an important object of the invention to provide a cart washer that includes a cleaning cycle for very dirty carts of approximately five minutes per cart.

Another object of the invention is to provide a cart washer that includes a platform with a plurality of smaller drain holes therein and which also includes larger openings in the platform to permit water from nozzles that are disposed on the floor to pass through and contact an underside of a cart, and wherein the platform elevates the cart above a sump containing water.

Still another object of the invention is to provide a cart washer that includes a ramp that is fixed to the cart and can pivot up from an outside of a door and lock the door closed.

Still yet another object of the invention is to provide a cart washer that uses 2.5 gallons of water per cycle.

Yet another important object of the invention is to provide a cart washer that can clean carts with either hot or cold water.

Still yet another important object of the invention is to provide a cart washer that includes a novel type of bellows pump with a variable drive gear to vary the rate of flow wherein the drive gear can be adjusted to make from one to three or more turns in a given amount of time, such as 15 seconds, and thereby vary the rate of intake.

A first continuing object of the invention is to provide a cart washer that includes a manual and automatic cycle.

A second continuing object of the invention is to provide a cart washer that includes a sufficient amount of nozzles to thoroughly wash the cart in a minimum amount of time.

A third continuing object of the invention is to provide a cart washer that includes elbows to change the direction of interior plumbing and provide sufficient pressure at all nozzles.

A fourth continuing object of the invention is to provide a cart washer that includes an interior lever to open a door from an inside of the cart washer that is in the frame and substantially identical to that on the outside.

A fifth continuing object of the invention is to provide a cart washer that is or can be UL approved.

A sixth continuing object of the invention is to provide a cart washer that does not leak.

A seventh continuing object of the invention is to provide a cart washer that can be used indoors because it does not leak.

An eighth continuing object of the invention is to provide a cart washer that includes a plurality of holes in a front lip to direct water running down the door or along the front to pass through the holes and into a collection sump disposed thereunder.

A ninth continuing object of the invention is to provide a cart washer that includes casters to permit transport of the cart washer from a storage location into a use location, and wherein at least one of the casters is a locking type of caster.

A tenth continuing object of the invention is to provide a cart washer that includes a filter screen over a sump.

An eleventh continuing object of the invention is to provide a cart washer that includes vents to keep a main pump cool during extended periods with an access door closed.

A twelfth continuing object of the invention is to provide a cart washer that includes positioning of fans on motors that helps to pull in outside air through vents that are provided during use.

A thirteenth continuing object of the invention is to provide a cart washer that requires a door over the motors to be closed during use.

A fourteenth continuing object of the invention is to provide a cart washer that includes drain holes on a floor of a motor compartment sufficient to drain any water that can accumulate therein and prevent submerging of either electrical components or any motor in the compartment if a hose should break or if another type of failure should occur that would discharge water into the motor compartment.

A fifteenth continuing object of the invention is to provide a cart washer that includes a sump which can hold up to ten gallons of water.

A sixteenth continuing object of the invention is to provide a cart washer that uses approximately five gallons of water in the sump per cart on automatic setting.

A seventeenth continuing object of the invention is to provide a cart washer that can wash a cart with as little as 2.5 gallons of water in the sump.

An eighteenth continuing object of the invention is to provide a cart washer that includes a main water input into a wash chamber and input for wash and rinse chemicals.

A nineteenth continuing object of the invention is to provide a cart washer that requires less frequent priming and that is easier to prime.

A twentieth continuing object of the invention is to provide a cart washer that does not lose prime when as little as 2.5 to 5 gallons of water are in the sump.

A twenty-first continuing object of the invention is to provide a cart washer that includes a manual fill button to fill the sump with water.

A twenty-second continuing object of the invention is to provide a cart washer that includes an overflow outlet in the wash chamber to drain excess water through a hose if excessive water is allowed to enter by misuse of the fill button or if an operator forgets to drain the sump after a previous use when the cart washer is in manual operating mode.

A twenty-third continuing object of the invention is to provide a cart washer that includes an overhead door that permits opening and changing or replenishment of chemicals from above, thereby permitting placement of the cart washer against a wall.

A twenty-fourth continuing object of the invention is to provide a cart washer that includes leveling legs attached to a bottom of the cart washer with locking nuts for when the cart is used in the same location.

A twenty-fifth continuing object of the invention is to provide a cart washer that includes wheels to permit storage of the cart washer in one location and facilitate its transport to another location for use.

A twenty-sixth continuing object of the invention is to provide a cart washer that permits a supervisor to secure a ramp in an upright position over a main door sufficient to prevent turning of a nut that is used to secure the ramp in an upright position after first verifying that the wash chamber is empty, thereby ensuring that the main door is secured in a closed position and that access to an interior of the wash chamber is prevented from occurring until the supervisor removes the mechanism that prevents turning of the nut.

A twenty-seventh continuing object of the invention is to provide, a cart washer that permits locking of a main door in a closed position without a lock being disposed on the main door.

A twenty-eighth continuing object of the invention is to provide a cart washer that permits locking of the main door in a closed position without visible evidence during use of the cart washer that a lock exists.

A twenty-ninth continuing object of the invention is to provide a cart washer that includes a ramp that is pivotally attached to the cart washer by a hinge and wherein the ramp is not removed from the cart washer during normal use and, accordingly, cannot be lost or misplaced.

A thirtieth continuing object of the invention is to provide a cart washer that includes a vent at a top for steam to escape during use.

A thirty-first continuing object of the invention is to provide a cart washer that includes a side door and a back door with a push-down-to-open keyhole that can include a key lock.

A thirty-second continuing object of the invention is to provide a cart washer that includes a solenoid controlled by a computer to open a fill valve for a predetermined period of time to fill a sump with a predetermined quantity of water.

A thirty-third continuing object of the invention is to provide a cart washer that includes dip switches that are set to variable positions and which control an amount of time that a solenoid is held in an open position to fill a sump with a predetermined quantity of water by a computer that reads the position of the dip switches.

A thirty-fourth continuing object of the invention is to provide a cart washer that includes a variable predetermined period of time to fill a sump with a predetermined quantity of water that is based on the available water pressure, wherein a greater time is provided for a lower inlet water pressure than for a higher inlet water pressure to fill the sump with the predetermined quantity of water.

A thirty-fifth continuing object of the invention is to provide a cart washer that uses dip switches to regulate the amount of water that enters a sump in the wash chamber by controlling the amount of time an input valve is held open and wherein the time, as established by the dip switches, is used when the cart washer is in an automatic setting or in a manual setting.

A thirty-sixth continuing object of the invention is to provide a cart washer that uses dip switches to regulate the amount of water that enters a sump in the wash chamber by controlling the amount of fill time that an input valve is held open and wherein the fill time, as established by the dip switches, is used when the cart washer is in an automatic setting or in a manual setting, and wherein the dip switches also regulate the amount of time that a drain pump is energized when the cart washer is in the automatic setting or in the manual setting, and wherein the drain pump is able to completely drain the quantity of water therein during the time allowed.

A thirty-seventh continuing object of the invention is to provide a cart washer that includes novel computer control software and/or firmware in combination with safety drainage structures whereby a cart washer is able to operate in either a manual mode or in an automatic mode using the same components.

A thirty-eighth continuing object of the invention is to provide a cart washer that permits manual filling and draining of the cart washer.

A thirty-ninth continuing object of the invention is to provide a cart washer that permits manual control of the cart washer.

A fortieth continuing object of the invention is to provide a cart washer that permits manual control of the number of cleaning cycles that occur per each cart that is being washed in order to optimally clean each cart, whereby an additional number of cleaning cycles are used for especially dirty carts.

A forty-first continuing object of the invention is to provide a cart washer that includes a sensor on the main door and wherein the cart washer is either shut off or disabled from operating if the main door is opened.

A forty-second continuing object of the invention is to provide a cart washer that is economical to use.

A forty-third continuing object of the invention is to provide a cart washer that can vary the quantity of a cleaning or rinse chemical that is used by varying the number of turns that a drive gear of a bellows type of pump makes per intake cycle which, accordingly, is used to vary quantity of the cleaning or rinse chemicals that are used.

A forty-fourth continuing object of the invention is to provide a cart washer that includes racks that can be disposed in a shopping cart for securing up to four hand baskets therein for cleaning of the hand baskets simultaneously with the shopping cart.

A forty-fifth continuing object of the invention is to provide a cart washer that permits the placement of up to four hand baskets on a bottom shelf of a shopping cart for cleaning of the hand baskets simultaneously with the shopping cart.

A forty-sixth continuing object of the invention is to provide a cart washer that includes a first bellows pump to draw in wash detergent and a second bellows pump to draw in a rinse chemical.

A forty-seventh continuing object of the invention is to provide a cart washer that includes an overhead rotating bar with a quantity of nozzles thereon, wherein the overhead rotating bar ensures that water is sprayed at various angles to optimally clean a cart.

A forty-eighth continuing object of the invention is to provide a cart washer that includes a ramp that has an upper end disposed proximate the same plane that a cart is disposed on when the cart is in the wash chamber thereby eliminating any lip that the wheels of the cart must pass over in order to be cleaned.

A forty-ninth continuing object of the invention is to provide a cart washer that includes a platform in a wash chamber that is elevated above a sump, wherein the platform is disposed at a height equal to a top of a ramp when the ramp is disposed in a downward position for use.

Briefly, a cart washer that is constructed in accordance with the principles of the present invention has a wash chamber that includes a main door and a ramp that is pivotally-attached to the cart washer under the main door and, when pivoted down, leads from a ground surface that is disposed under the cart washer to a bottom of a main opening that provides access into the wash chamber when the main door is open. A two-piece platform is disposed in the wash chamber and is elevated above a basin. A sump is included in the basin. The cart washer includes an automatic and a manual mode of operation, the differences of which are described. During use, a first quantity of fresh water enters the basin and sump and combines with a wash detergent that is sprayed through an interior plumbing system through nozzles and on a shopping cart that is placed in the wash chamber for a predetermined amount of time. The used water and wash detergent are then pumped from the cart washer and a second quantity of fresh water enters and combines with a rinse solution that is sprayed on the cart for a second predetermined amount of time. The used water and rinse solution are then drained to complete the cleaning cycle for the shopping cart.

Figure 1:
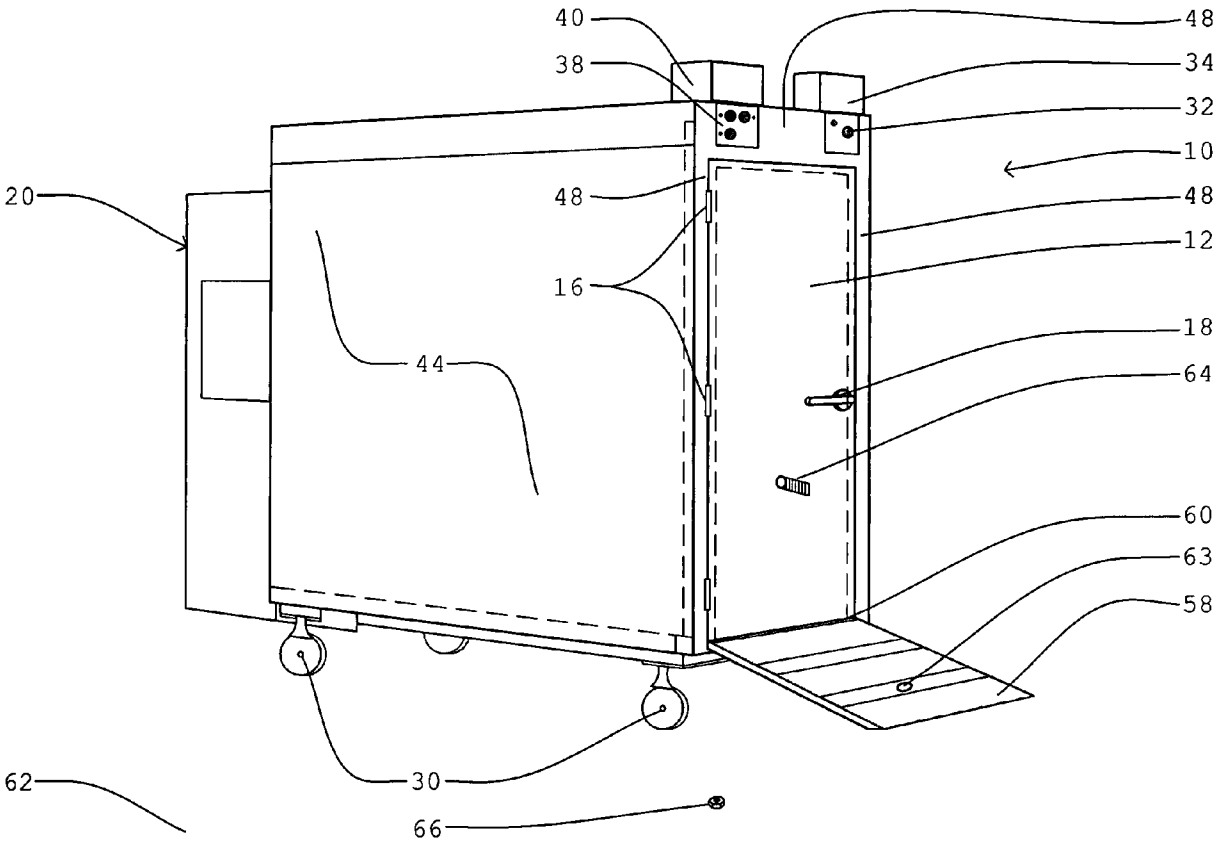
FIG. 1 is a front and left-side view in perspective of a cart washer with a main door closed and a ramp in a downward position.

Appendix 1 includes operating instructions that provide detailed instructions for operating the cart washer of FIG. 1.

Appendices 10-36 include manufacturing detailed drawings and other information useful for a more complete understanding of manufacture of the cart washer of FIG. 1.

DETAILED DESCRIPTION OF THE INVENTION

Referring on occasion to all of the FIGURE drawings and now, in particular to FIG. 1, is shown a cart washer, identified in general, by the reference numeral 10.

The reader will notice that reference is occasionally made throughout the DETAILED DESCRIPTION OF THE INVENTION suggesting that the reader view a particular drawing FIGURE. The suggestion is at times made when the introduction of a new element requires the reader to refer to a different drawing FIGURE and also when the timely viewing of another drawing FIGURE is believed to significantly improve ease of reading or enhance understanding. To promote optimum understanding of the instant invention the reader is encouraged to periodically refer to each enclosed FIGURE.

It is to be noted that for purposes of clarity the term "water" as used herein refers to a fluid in the cart washer 10. The fluid can be pure water that has just filled the sump or it can be water combined with a wash detergent or with a rinse solution. Any preferred wash detergent or rinse solution can be used, as desired, although the use of bio-degradable substances is preferred. The rinse solution can include any preferred type of chemical that facilitates the rinsing of the cart including the use of a surfactant, if desired. It is expected that the manufacturer of the cart washer 10 will supply and urge that the use of the wash detergent and rinse solution be limited only to a preferred wash detergent and rinse solution as recommended by the manufacturer.

The cart washer 10 includes a main door 12 and a wash chamber, identified in general by the reference numeral 14 (FIG. 2) that is accessed by opening the main door 12. The main door 12 is disposed at a front of the cart washer 10. The main door 12 includes hinges 16, about which it pivots, and a handle 18 to open and secure the main door 12 in a closed position.

A portion of the handle 18 extends through the main door 12 and includes an interior handle attached thereto that permits opening of the main door 12 from the wash chamber 14, in the unlikely event that someone would enter therein and the main door 12 be closed. For this reason, the main door 12 does not include a lock. However, it is possible to secure or even lock the main door 12 in a closed position (not shown), and this is described in greater detail hereinafter.

Figure 15:
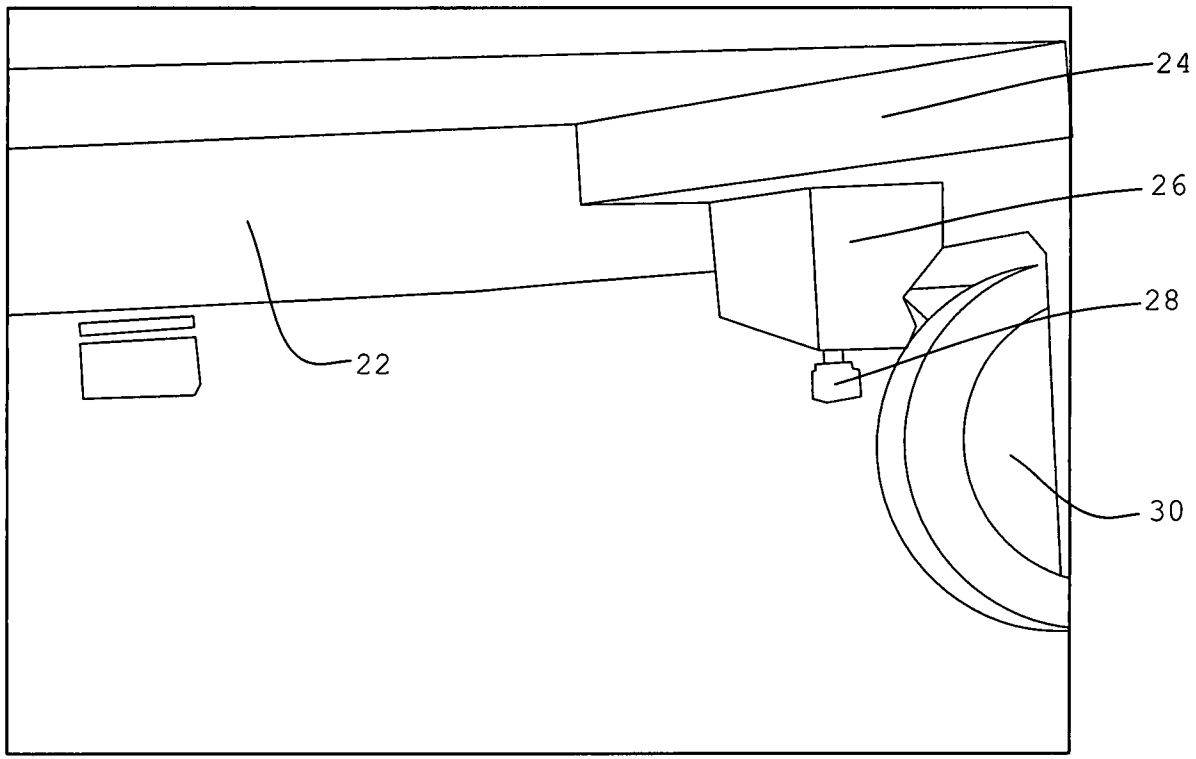
FIG. 15 is an enlarged side view in perspective of a bottom portion of the cart washer of FIG. 1.

Disposed adjacent to the wash chamber 14 is a rear compartment, identified in general by the reference numeral 20. The contents of the rear compartment 20 are described in greater detail hereinafter. A frame 22 structure (see FIG. 15) extends around a bottom perimeter of the cart washer 10. Other frame members, such as gussets 24, are attached (welded or bolted, as desired) to the frame 22 where needed. Vertical and interconnecting structural support members are similarly attached to the frame 22 in accordance with mechanical engineering design practices. A remainder of the primary component parts of the cart washer 10, as is disclosed herein, are attached to each other and to the various members of the frame 22.

Leveling brackets 26 and leveling bolts 28 are attached to four perimeter gussets 24 and are used to level the cart washer 10 during normal use. Four locking casters 30 (FIG. 1 and FIG. 15) provide the ability to transport the cart washer 10 from an interior of a building to an external area for use. Some users will store the cart washer 10 indoors and, using the casters 30, roll it out of doors for use while other users will find a permanent place to both store and use the cart washer 10 indoors. Regardless of where the cart washer 10 is used, it should be leveled prior to use for proper operation. The reason for this is described in greater detail hereinafter.

Figure 13:
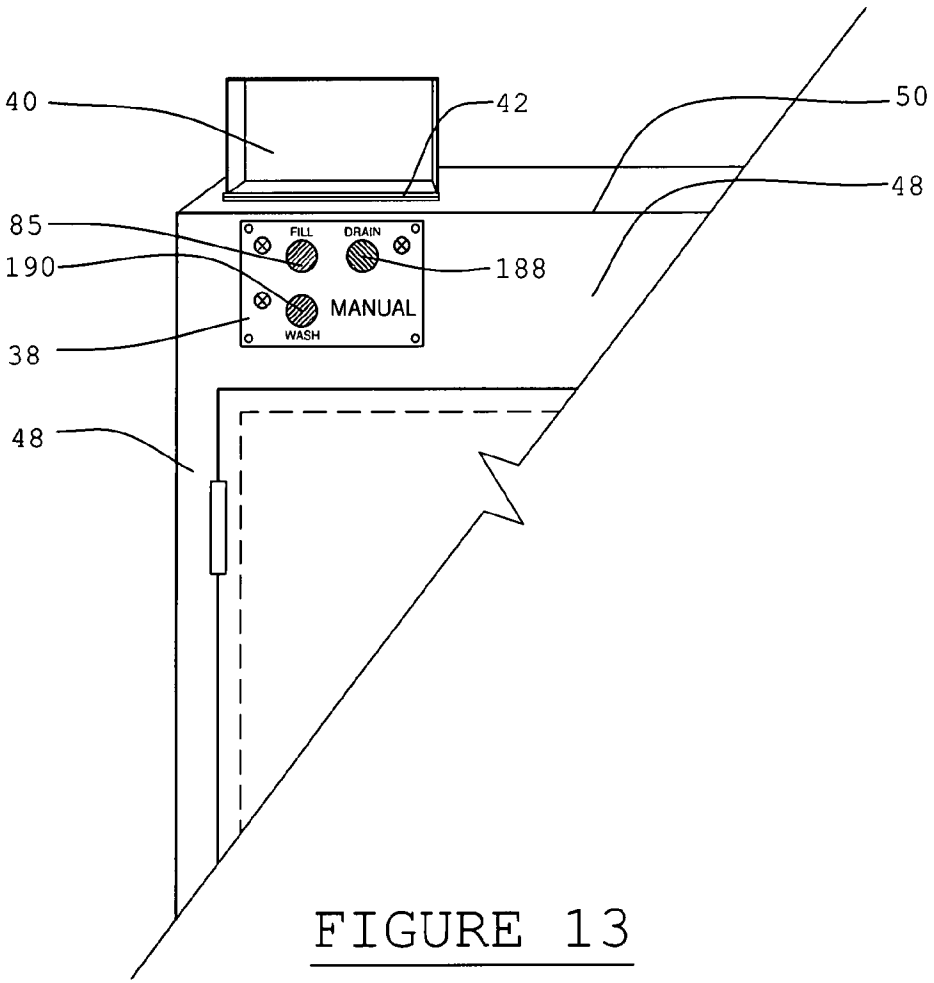
FIG. 13 is an enlarged front view in perspective of an upper left side portion of the cart washer of FIG. 1.
Figure 14:
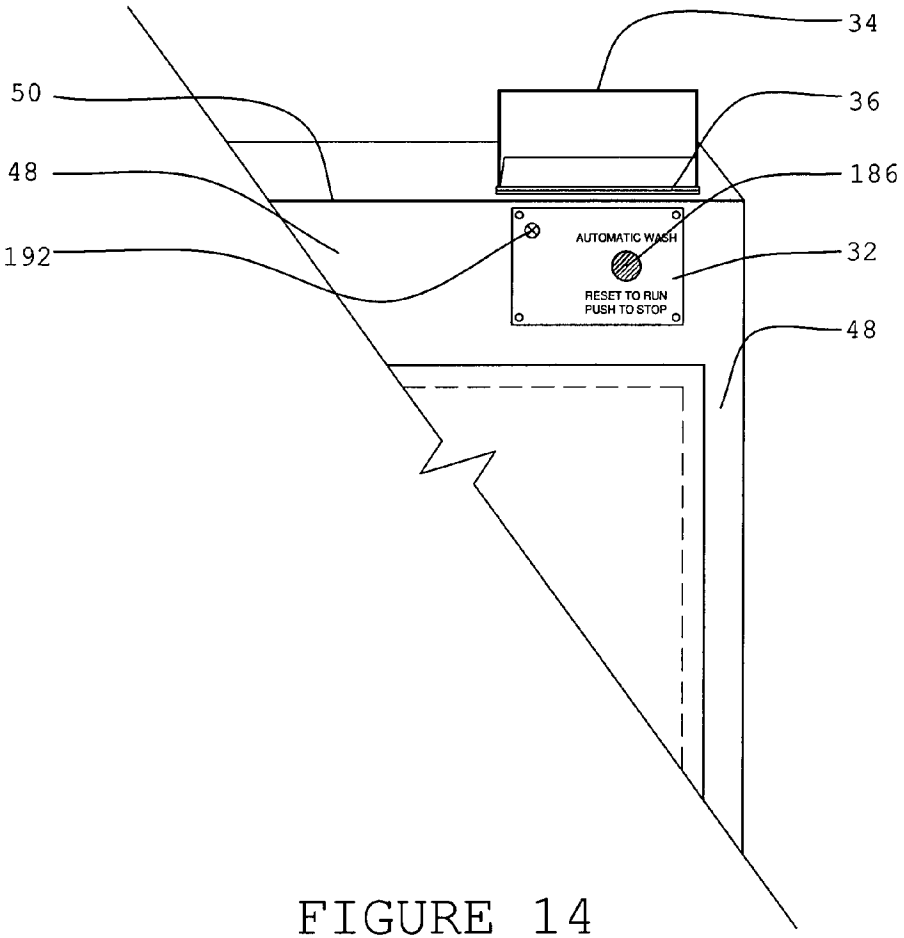
FIG. 14 is an enlarged front view in perspective of an upper right side portion of the cart washer of FIG. 1.

Referring again primarily to FIG. 1 and also to either FIG. 13 or FIG. 14 an automatic mode control panel 32 is disposed on the upper right side of the front of the cart washer 10, to a front sidewall panel 48 above the main door 12. The front sidewall panel 48 surrounds the right side, left side, top and, as desired, a small area that is disposed below the main door 12. An automatic mode panel cover 34 is attached to a first panel hinge 36 about which it pivots. The first panel hinge 36 is attached to an upper ceiling panel 50 at a front of the cart washer 10 immediately above the automatic mode control panel 32.

The automatic mode panel cover 34 is shown pivoted into an open position for access to the automatic mode control panel 32. The automatic mode control panel 32 is used when the automatic mode, or stated in other words, when an automatic wash cycle of the cart washer 10 is preferred. The automatic mode panel cover 34 is pivoted downward into a closed position (not shown) to protect the automatic mode control panel 32 and prevent inadvertent actuation of the automatic mode when the manual mode of the cart washer 10 is being used.

A manual mode control panel 38 is disposed on the upper left side of the front sidewall panel 48 of the cart washer 10, above the main door 12. A manual mode panel cover 40 is attached to a second panel hinge 42, about which it pivots. The second panel hinge 42 is attached to the upper ceiling panel 50 at a front of the cart washer 10 immediately above the manual mode control panel 38. The manual mode panel cover 40 is shown pivoted into an open position for access to the manual mode control panel 38.

The manual mode control panel 38 is used when the manual mode for controlling operation of the cart washer 10 is preferred. The manual mode panel cover 40 is pivoted downward into a closed position to protect the manual mode control panel 38 and prevent inadvertent actuation of the manual mode when the automatic mode of the cart washer 10 is being used.

During storage, both the automatic mode panel cover 34 and the manual mode panel cover 40 are pivoted into their respective closed positions. In normal use only one would be open while the other would be closed. The right and left covers protect the switches and prevent inadvertent operation.

A left sidewall panel 44 is disposed to the left side of the wash chamber 14 when viewed from the front. A right sidewall panel 46 (FIG. 5) is disposed on an opposite side of the wash chamber 14, as compared to the left sidewall panel 44, and is parallel thereto.

Figure 12:
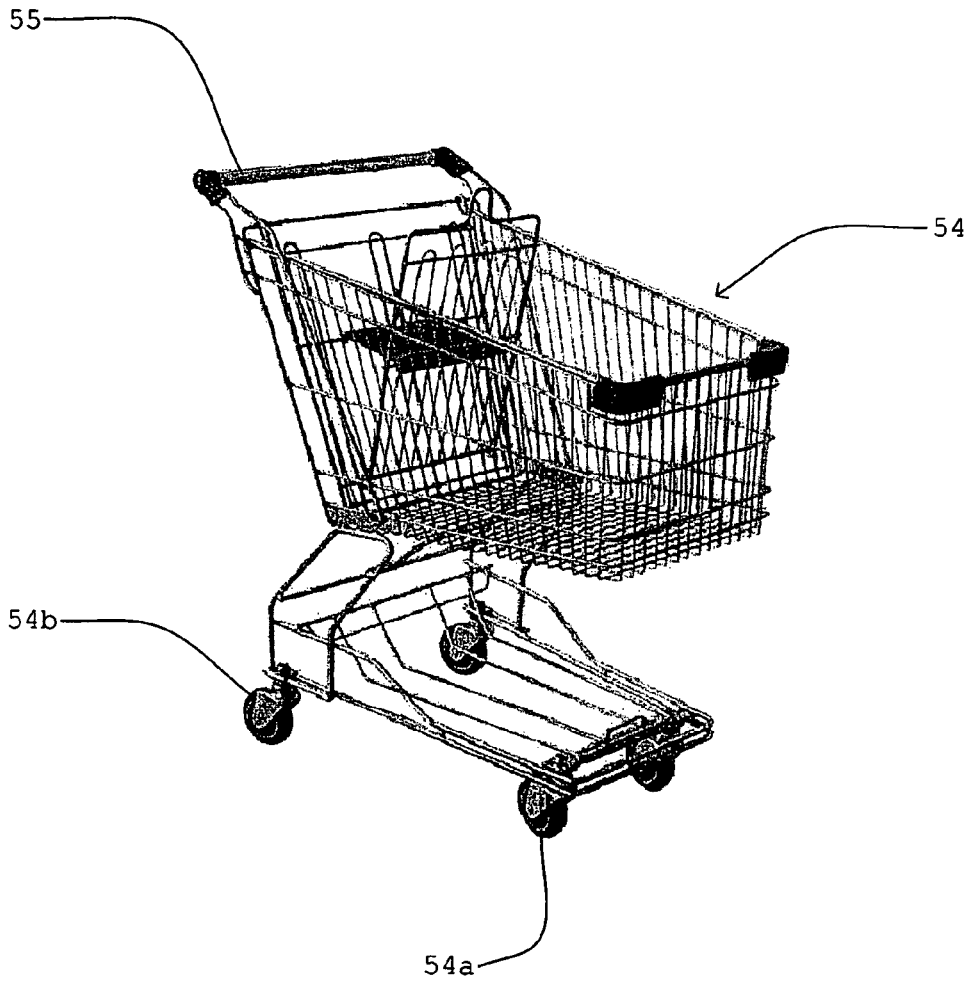
FIG. 12 is a side view in perspective of a cart that is cleaned by the cart washer of FIG. 1.

A rear sidewall panel 52 (FIG. 10) is disposed at an opposite end of the wash chamber 14 as compared to the front sidewall panel 48 and the main door 12. The rear sidewall panel 52 extends fully down the vertical height of the wash chamber 14, equal to that of the height of the front sidewall panel 48 and the main door 12. When the main door 12 is pivoted into an open position, a main opening is provided that provides access into the wash chamber 14 to place a shopping cart, identified in general by the reference numeral 54 (FIG. 12), in the wash chamber 14 or remove the shopping cart 54 therefrom.

A floor 56 (FIG. 3) is provided in the wash chamber 14 and is disposed at an opposite end of the wash chamber 14 with respect to the ceiling panel 50.

Together, the floor 56, the ceiling panel 50, the left sidewall panel 44, the right sidewall panel 46, the rear sidewall panel 52, and the front sidewall panel 48 and the main door 12 provide an overall enclosure for the wash chamber 14 that is sufficiently watertight.

A ramp 58 (FIG. 1) is pivotally-attached to the front sidewall panel 48 of the cart washer 10 under the main door 12 by a ramp hinge 60. When the ramp 58, as shown, is pivoted into a downward position, an inclined plane is provided that leads from a ground surface 62 that is disposed under the cart washer 10 to a bottom of the main opening (i.e., a bottom of the main door 12). See also FIG. 2. The ramp 58 provides easy access into the wash chamber 14 when it is pivoted into the downward position and the main door 12 is open.

A small ramp hole 63 is provided through the ramp 58. A threaded rod 64 extends outward from the main door 12. When the ramp 58 is pivoted into an upward position (not shown) wherein a plane of the ramp 58 is disposed parallel with and adjacent to a front surface of the main door 12, the threaded rod 64 passes through the ramp hole 63 and an exposed end of the threaded rod 64 is accessible from the raised underside of the ramp 58.

The upward position for the ramp 58 is used when the cart washer 10 is not being used. A nut 66 is shown on the ground surface 62 for convenience, although it would normally be attached to the threaded rod 64 when the ramp 58 is in the downward position or in the upward position. The nut 66 cooperates with screw threads of the threaded rod 64 and is used to secure the ramp 58 in the upward position. A washer (not shown) may also be used, if desired.

When the ramp 58 is secured in the upward position the main door 12 is prevented from opening. Accordingly, care must be taken to first ensure that the wash chamber 14 is void of any shopping carts 54 or, worse yet, any living thing before securing the ramp 58 in the upward position.

If desired, a key operated or padlock type of locking mechanism (not shown) can be placed over the nut 66 when the ramp 58 is secured in the upward position to surround the nut 66 and thereby prevent its removal. This prevents unauthorized use of the cart washer 10. For safety and security reasons, a supervisor would typically ensure that the wash chamber 14 was empty before applying any type of locking device mechanism to prevent removal of the nut 66 from the threaded rod 64.

An exterior of the cart washer 10 is painted, finished, or decorated as desired to enhance its appearance. A pattern of bubbles is shown as a preferred surface covering. To increase visibility of the threaded rod 64, the surface covering of bubbles has been removed proximate the threaded rod 64.

It is desirable to note that, for safety reasons, safety regulations (as established by any governing safety body, standard, or organization) generally prohibit the main door 12 from being locked when the cart washer 10 is in use in such manner that it cannot be opened from inside the wash chamber 14. Accordingly, for compliance reasons it is generally accepted that the main door 12 cannot include a lock attached thereto. However, the user of the cart washer 10 may, at times, want to secure the main door 12 in a closed position and, at other times, lock it so that the main door 12 cannot be opened by unauthorized personnel and thereby prevent the cart washer 10 from being used when not desired or for purposes for which it is not intended.

The use of the ramp 58, as described herein, provides a novel way to secure the main door 12 in a closed position and, if desired, to lock the main door 12 in the closed position without including any type of a lock that is attached to the main door 12. Thereby, regulations are satisfied as are the needs of the user of the cart washer 10.

A left platform half 68 (FIG. 2) is disposed adjacent to a right platform half 70 and which, together, provide a platform (68, 70 combined) in the wash chamber 14 that is elevated above the floor 56. A top surface of the platform 68, 70 is equal in elevation above the ground surface 62 as is a top ramp edge 74 of the ramp 58 and as is a lower door lip 72. The lower door lip 72 is disposed immediately under the main door 12 when the main door 12 is closed. The importance of the lower door lip 72 is described hereinafter.

Elevation of the platform 68, 70 above the floor 56 is achieved in various ways, as desired. For example, elevated support members may be included and attached to an interior of the wash chamber 14 where desired. The support members may be placed along the ends, perimeter, or even on the floor 56 where desired beneath the platform 68, 70. The support members, if used, provide support for and also elevate the platform 68, 70 the desired amount above the floor 56. Alternately, the support members may instead be attached to an underside of the left platform half 68 and the right platform half 70 to displace (i.e., elevate) the platform 68, 70 the desired amount.

Alternately still, the left platform half 68 and the right platform half 70 may each instead be formed to include sides or perimeters portions that extend downward and away from a top surface of the platform 68, 70 by a desired amount. The sides or perimeter portions would rest on the floor 56 and elevate the platform 68, 70 the desired amount. A combination of these approaches or other methods can be utilized, as desired, to elevate the left platform half 68 and the right platform half 70 the desired amount.

During use, to place the shopping cart 54 in the wash chamber 14 for cleaning, the ramp 58 is first placed in the downward position and the main door 12 is unlatched by use of the handle 18 and pivoted into a fully open position to provide access to the main opening. The shopping cart 54 to be cleaned is urged forward by applying a force to a shopping cart handle 55 (FIG. 12) sufficient to cause the shopping cart 54 to roll on a pair of front cart wheels 54*a* and on a pair of rear cart wheels 54*b* up the ramp 58, over the lower door lip 72 that is even in elevation with respect to the top ramp edge 74, and onto the platform 68, 70 in the wash chamber 14. The main door 12 is closed and latched shut.

The cart washer 10, as is described in greater detail hereinafter, is then used to wash the shopping cart 54. After washing, the shopping cart 54 is removed by unlatching and opening the main door 12 and urging the shopping cart 54 out of the wash chamber 14, down the ramp 58, and back onto the ground surface 62 for reuse by store customers. The process is repeated for additional carts until all have been cleaned.

Figure 3:
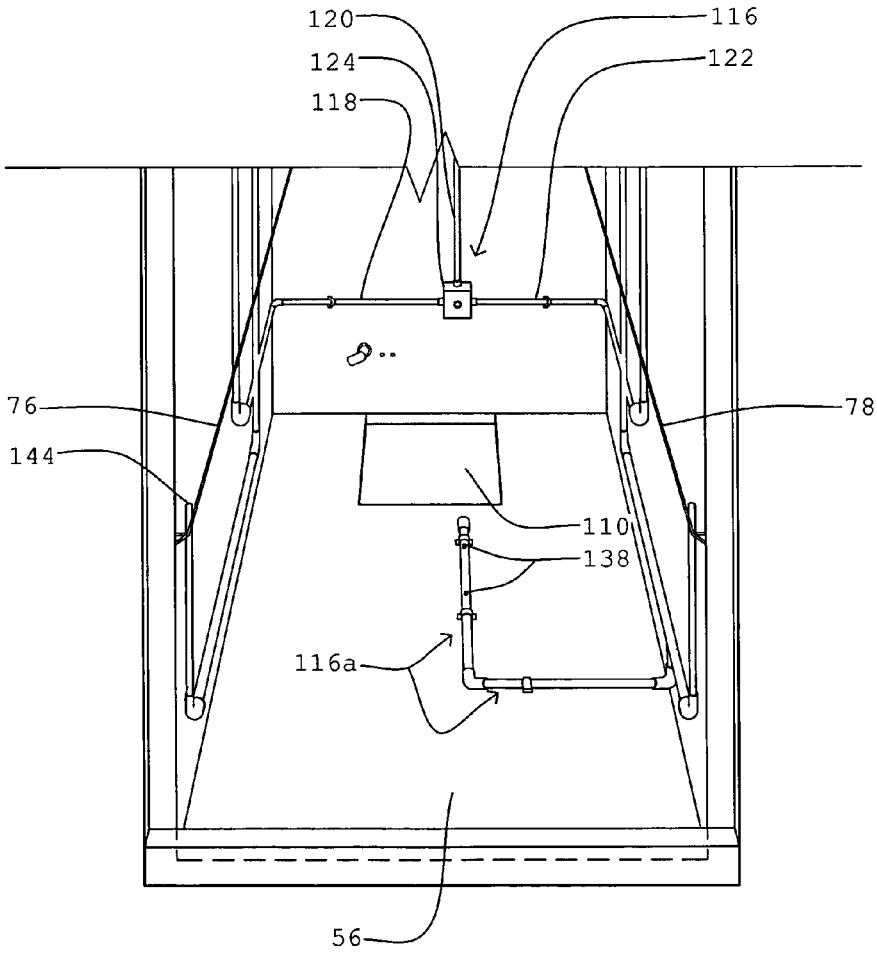
FIG. 3 is a front view in perspective of the cart washer of FIG. 2 with a left platform half and a right platform half removed to reveal a floor.
Figure 5:
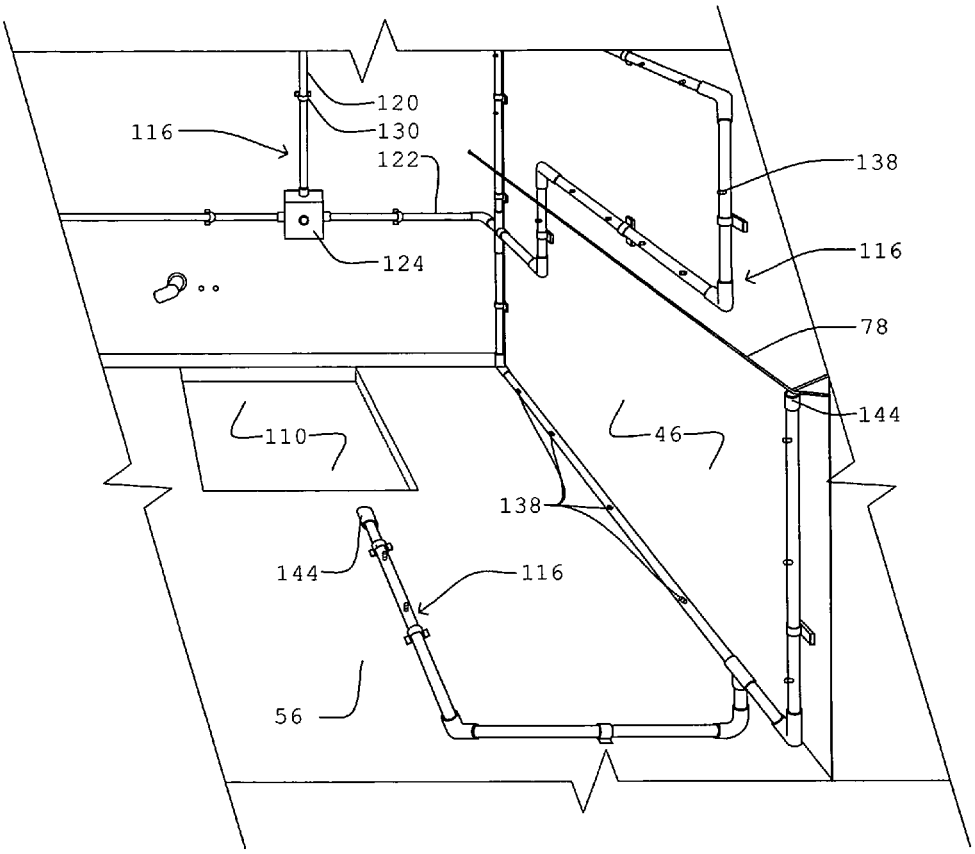
FIG. 5 is a front and right-side view in perspective of the cart washer of FIG. 3 showing a right portion of an interior of a wash chamber.
Figure 6:
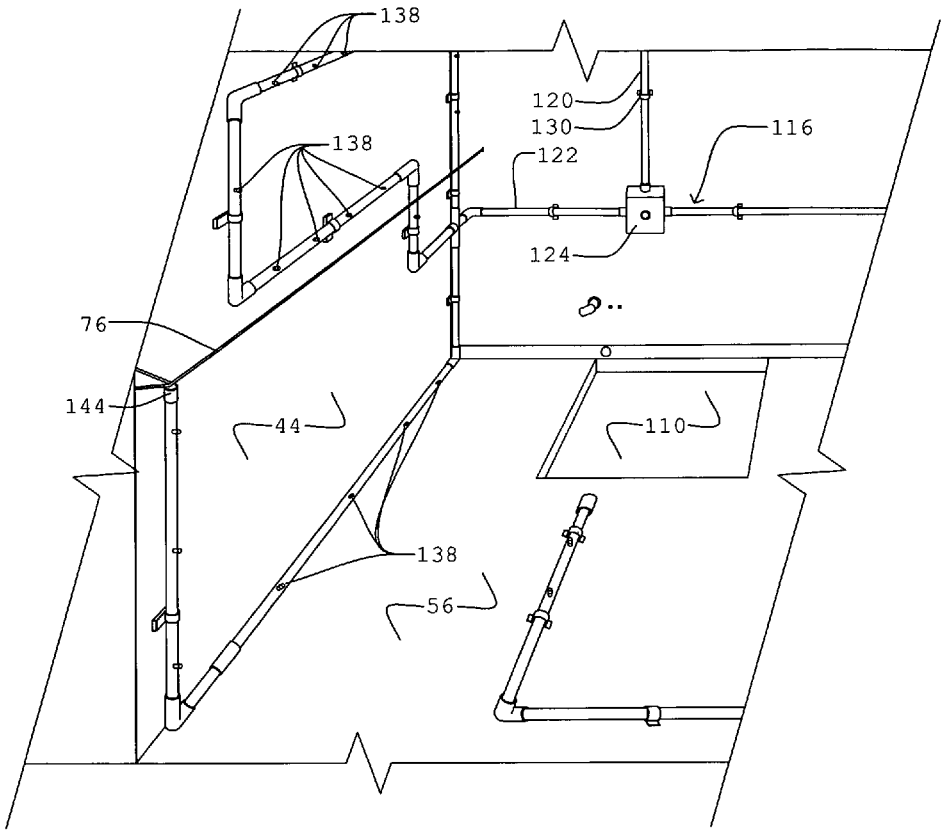
FIG. 6 is a front and left-side view in perspective of the cart washer of FIG. 3 showing a left portion of an interior of a wash chamber.

Proper positioning of the shopping cart 54 in the wash chamber 14 is controlled along the left side by a left guard rail 76 (FIG. 3 or FIG. 6) and along the right side by a right guard rail 78 (FIG. 3 or FIG. 5). The left and right guard rails 76, 78 extend inward a predetermined distance away from the left and right side panels 44, 46, respectively, to prevent the shopping cart 54 from impacting and possibly damaging component parts of an interior plumbing system of the wash chamber 14 of the cart washer 10 that are attached to the left and right side panels 44, 46.

Component parts of the interior plumbing system are also attached to the ceiling panel 50, the rear sidewall panel 52, and the floor 56. The interior plumbing system includes all of the plumbing components that are disposed in the wash chamber 14 and is described in greater detail hereinafter.

An elevated left cart stop strip 80 is attached to a top of the left platform half 68 (FIG. 2) where desired. Typically, it is attached about six or so inches away from the rear sidewall panel 52. An elevated right cart stop strip 82 is similarly attached to a top of the right platform half 70 (FIG. 2) where desired, which generally is at the same distance from the rear sidewall panel 52 that the left cart stop 80 is positioned.

When the shopping cart 54 is urged into the wash chamber 14, the front cart wheels 54*a* impact the left and right cart stop strips 80, 82 and prevent further forward motion by the shopping cart 54. This protects any of the components of the interior plumbing system that are attached to the rear sidewall panel 52 from being impacted and possibly damaged.

Figure 4:
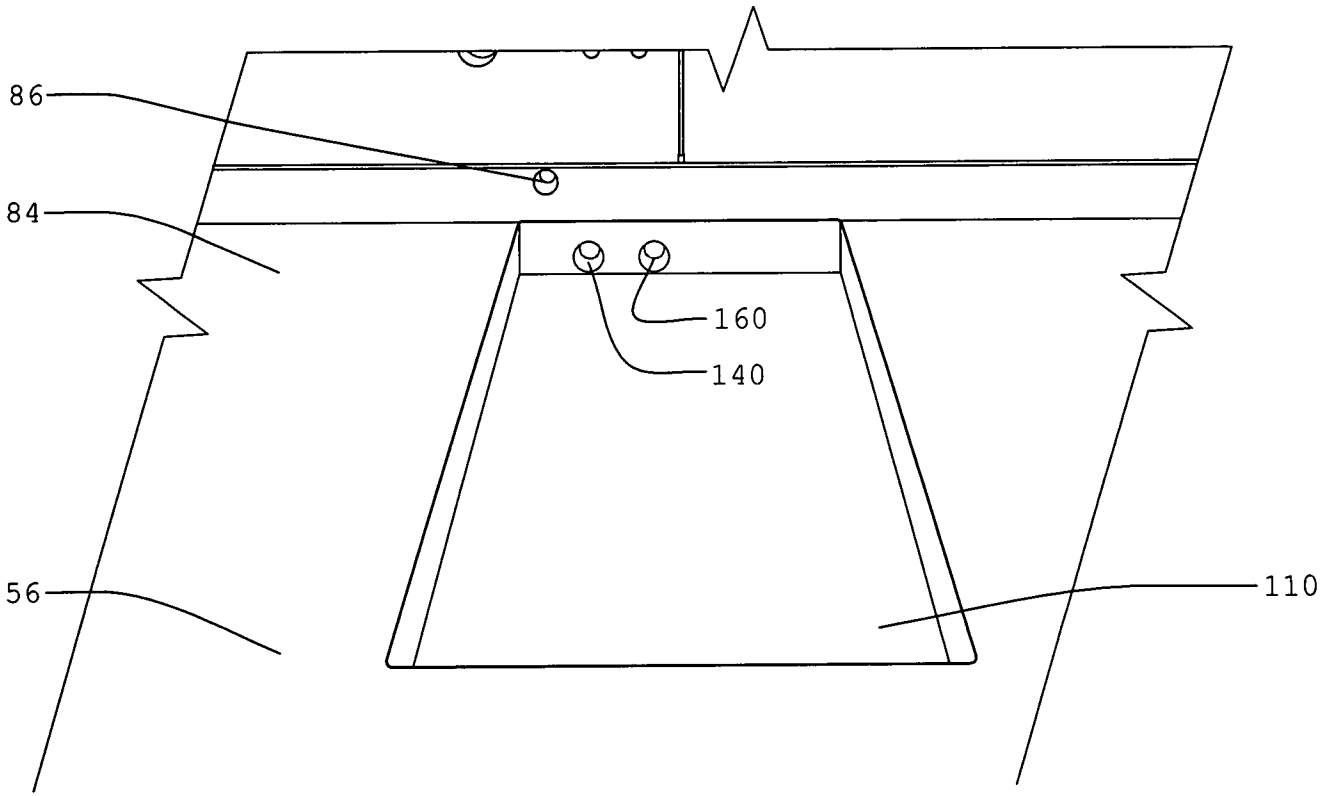
FIG. 4 is an enlarged front view in perspective of the cart washer of FIG. 3 showing detail of a basin and a sump that is provided in the floor.

A basin 84 is provided by an elevated area that is disposed over the floor 56 (FIG. 4). The basin 84 is defined as that portion of a bottom of the wash chamber 14 that extends upward from the surface of the floor 56 up to a bottom of a wash chamber overflow fitting 86. Therefore, the elevated area that forms the basin 84 is typically only a couple of inches higher than the floor 56.

Figure 8:
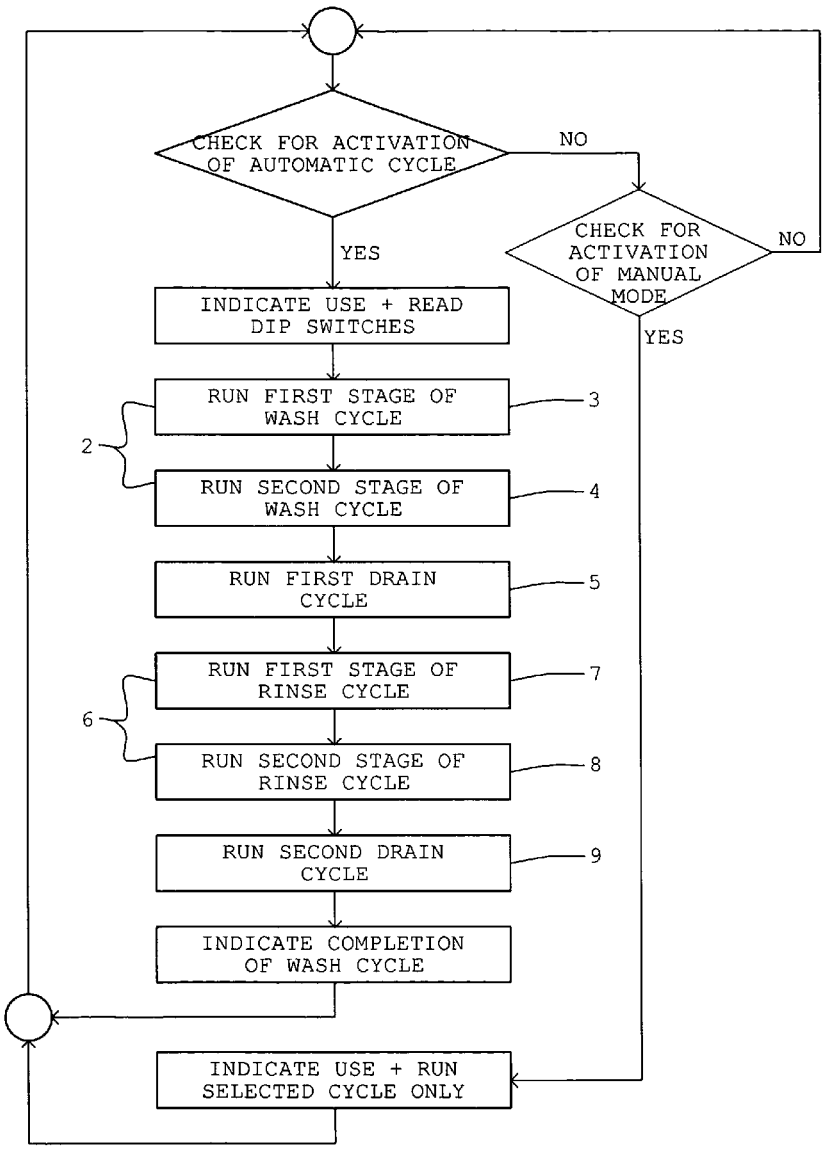
FIG. 8 is a flow chart of an executive operating system of the cart washer of FIG. 1 that represents one embodiment of software to control the functioning of a computer that is included.
Figure 9:
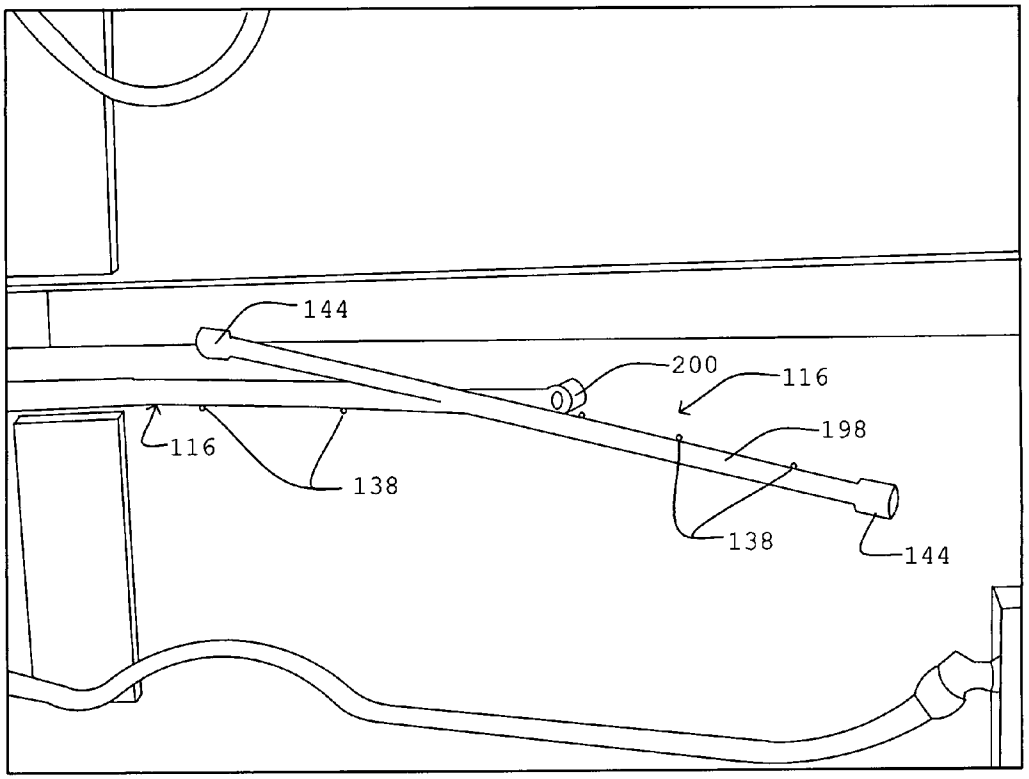
FIG. 9 is a view in perspective of the rotating bar of the cart washer of FIG. 7.

The basin 84 provides the volume necessary to accumulate a quantity of water needed for a wash cycle (identified by bracket 2, FIG. 8) and a rinse cycle (identified by bracket 6, FIG. 8). The wash cycle 2 includes a first stage of the wash cycle 3 and a second stage of the wash cycle 4. The rinse cycle 6 includes a first stage of the rinse cycle 7 and a second stage of the rinse cycle 8. The basin 84 can hold up to five gallons and, if desired, it can be modified to hold even more water. A normal quantity of water that is used with the wash cycle 2 is 2.5 gallons. The same quantity of water is also typically used for the rinse cycle 6.

When the basin 84 is filled with water the height of the water is still below an upper surface of the platform 68, 70. Therefore, the shopping cart 54 is never sitting in a pool of water.

The wash chamber overflow fitting 86 provides a port whereby gravity is used to drain any overflow condition of water that might occur in the basin 84 of the wash chamber 14 and, thereby, prevent the water level from rising to an level where it begins to leak out from over the lower door lip 72 and under a bottom of the main door 12. A possible way to create such an overflow condition in the wash chamber 14 is by using the cart washer 10 in the manual mode and repeatedly pressing a manual fill button 85 (FIG. 13), which is misuse of the cart washer 10. The wash chamber overflow fitting 86, as described hereinafter, helps to mitigate such misuse.

Figure 10:
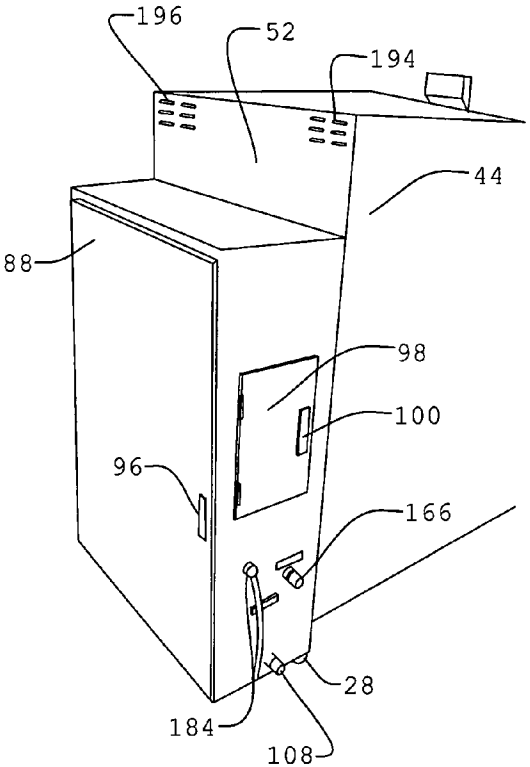
FIG. 10 is a rear and left-side view in perspective of the cart washer of FIG. 1.
Figure 11:
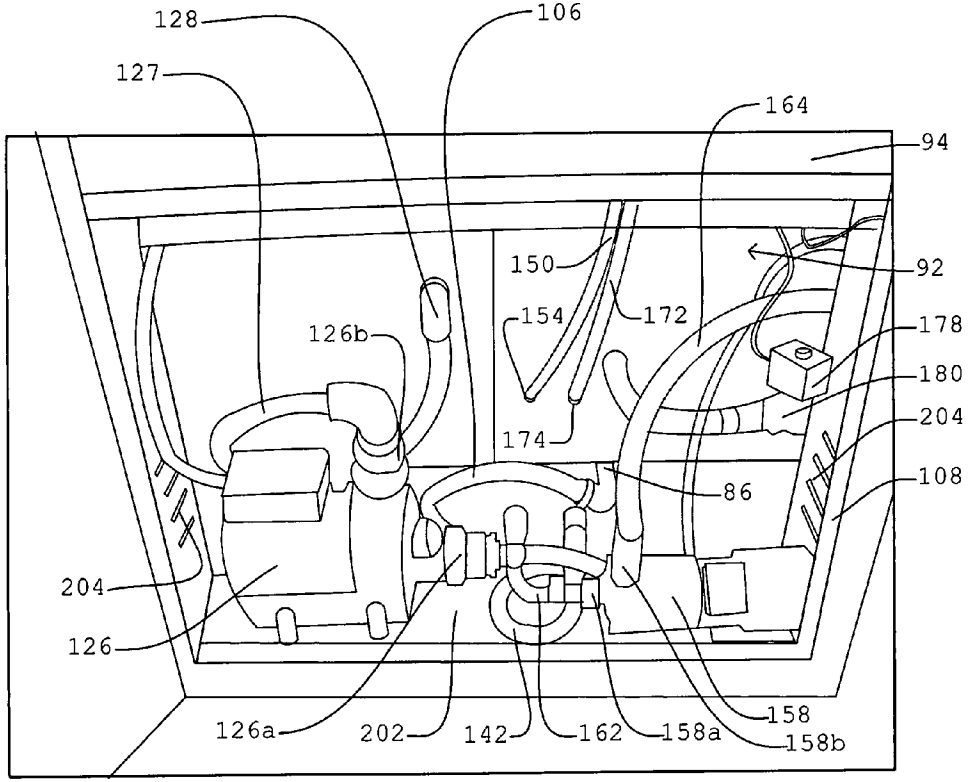
FIG. 11 is a rear view in perspective of a lower chamber of the cart washer of FIG. 1.

Referring momentarily to FIG. 10, a hinged rear door 88 provides overall access to a rear compartment area. The rear compartment area includes an upper chamber 90 (FIG. 16) and a lower chamber 92 (FIG. 11). The lower chamber 92 is disposed under the upper chamber 90 and is separated from the upper chamber by a shelf 94. The rear door 88 includes a first key lock 96 and, when opened, provides access to an interior of both the upper chamber 90 and he lower chamber 92. A hinged side door 98 is also provided and it includes a second key lock 100. The side door 98 provides access to the upper chamber 90 and an alternate way of accessing a wash detergent container 102 (FIG. 16) and a rinse solution container 104 that are disposed in the upper chamber 90 to replace these fluids when needed.

Referring again momentarily to FIG. 11, an opposite end of the wash chamber overflow fitting 86 is disposed in the lower chamber 92 and is attached to a first end of an interior drain hose 106. An opposite second end of the interior drain hose 106 is attached to an inside end of an overflow drain outlet 108. An outside end of the overflow drain outlet 108 (FIG. 10) includes a gravity drain hose connection below the side door 98.

A gravity drain hose (not shown) is attached to the overflow drain outlet 108 and directed to a low drain (not shown) that is lower in elevation (i.e., typically in the ground surface 62). A tray (not shown) can optionally be used to collect water if the low drain is not available. Modification can then be made to the cart washer 10 to remove water from the tray and pump it to an elevated drain (not shown). The overflow drain outlet 108 is disposed proximate one of the leveling bolts 28.

A sump 110 (FIG. 3, 4, 5, 6) is included as a rectangular recess or depression that is provided in the floor 56 in the basin 84. When in normal use, the platform 68, 70 is disposed over the basin 84, sump 110, and floor 56. The relationship of the floor 56 to the sump 110 is discussed in greater detail hereinafter.

Each half of the platform 68, 70 includes a plurality of smaller drain holes 112 therein that allow water to drain through the platform 68, 70 and into the basin 84 and sump 110. A plurality of larger nozzle openings 114 are provided in at least one of the platform halves 70. The use of the nozzle openings 114 are discussed in greater detail hereinafter.

During normal use, as previously mentioned, the shopping cart 54 is urged up the ramp 58 and into the wash chamber 14. The wheels 54*a*, 54*b* of the shopping cart 54 rest on the platform 68, 70. Because the motion does not include any ledges, steps, or sudden changes in elevation it is fast and easy to urge the shopping cart 54 in and out of the wash chamber 14. This helps to increase the through-put of the cart washer 10 and it also prevents a user from having to lift the shopping cart 54 up over any ledge. This also lessens the chance of injury An interior plumbing system (FIG. 3-6, 9), identified in general by the reference numeral 116, extends around and is attached to an interior of the wash chamber 14 in part to the floor 56, the ceiling panel 50, the left sidewall panel 44, the right sidewall panel 46, and the rear sidewall panel 52.

The interior plumbing system 116 is comprised of three primary branch circuits that include of a first branch 118, a second branch 120, and a third branch 122 of conduit that emanate from a water distribution junction box 124. While any type of conduit desired may be used, schedule 80 PVC is preferred. The first branch 118 supplies and includes all of the conduit that is attached to the left sidewall panel 44. The second branch 120 supplies and includes all of the conduit that is attached to the ceiling panel 50. The third branch 122 supplies and includes all of the conduit that is attached to the right sidewall panel 46 and the floor 56.

The two basic cycles that are necessary to properly wash and clean the shopping cart 54 include the wash cycle 2 which is followed by the rinse cycle 6. These cycles are described in greater detail hereinafter. During an initial first stage of the wash cycle 3 or first stage of the rinse cycle 7, a desired quantity of fresh water is allowed to flow into the basin 84 and sump 110. How the fresh water enters is discussed in greater detail hereinafter.

After filling the sump 110 and basin 84, the first stage cycle (3 or 7) then progresses to a second stage cycle (4 or 8) in which the water that is disposed in the basin 84 and sump 110 is drawn by a vacuum generated by a first impeller pump 126 (FIG. 11) into an intake port 126*a* of the first impeller pump 126. The water exits from a discharge port 126*b* of the first impeller pump 126 at an elevated pressure. This is described in greater detail hereinafter.

Figure 2:
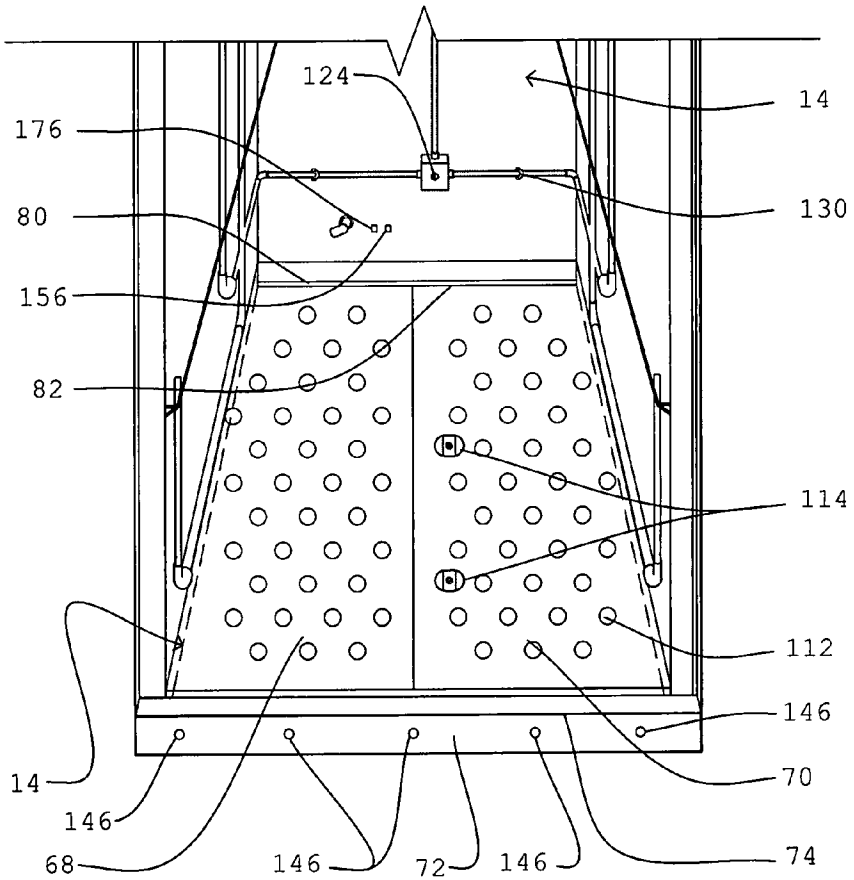
FIG. 2 is a front view in perspective of the cart washer of FIG. 1 with a main door open and a ramp in a downward position showing an interior of a wash chamber.

The water passes through the first impeller pump 126 and is supplied at elevated pressure passing through a pressure supply hose 127 and a pressure supply fitting 128 in the lower chamber 92. The pressure supply fitting 128 passes through the rear sidewall panel 52 and connects to the junction box 124. The three primary branch circuits 118, 120, 122 extend from the junction box 124 that is attached to the rear sidewall panel 52 to the ceiling panel 50, the left sidewall panel 44, the right sidewall panel 46, and the floor 56 and are attached thereto by brackets 130 (FIG. 2).

After filling with water, the first impeller pump 126 is energized by a computer 132 (FIG. 16) during the second stage of the wash cycle 4 and the second stage of the rinse cycle 8. When the first impeller pump 126 is energized, the junction box 124 fills with water that is supplied under pressure from the first impeller pump 126. The computer 132 is attached to a circuit board 134 in an electrical panel 136 that is located in the upper chamber 90.

The junction box 124 is used as a water distribution box to supply water under pressure to each of the branch circuits 118, 120, 122. The junction box 124 helps maintain a uniformly high pressure at each of three inlets to the branch circuits 118, 120, 122 as well as an abundant supply of water. Accordingly, optimum pressure and rate of flow into each of the branch circuits 118, 120, 122 is provided by the junction box 124.

A plurality of nozzles 138 are attached to the conduit of the branch circuits 118, 120, 122, where desired to ensure ample coverage, and are used to direct the flow of water to the shopping cart 54 that is placed in the wash chamber 14 for cleaning. The nozzles 138 are individually selected to provide any desired type of spray pattern.

The first impeller pump 126 is used as a pressure pump to draw water from the sump 110 through an intake opening 140 (FIG. 4) that is provided near the bottom of the sump 110, through an intake hose 142 (FIG. 11), into the intake port 126*a*, out the discharge port 126*b*, through the pressure supply hose 127, to the junction box 124, and through the interior plumbing system 116 at a sufficiently elevated pressure and rate of flow. A preferred model for the first impeller pump 126 is a WHIRLPOOL TM MODEL TDA 75.

The pressurized water supplied by the first impeller pump 126 flows through the interior plumbing system 116 and simultaneously out of all of the nozzles 138 during the second stage of the wash cycle 4 and the second stage of the rinse cycle 8. The platform 68, 70 is disposed over a floor portion 116*a* (FIG. 3) of the interior plumbing system 116 that extends along and is attached to the floor 56. Therefore the wheels 54*a*, 54*b* of the shopping cart 54 do not contact the floor portion 116*a* of the interior plumbing system 116. This avoids the difficulty of otherwise having to urge the shopping cart 54 over the floor portion 116*a*.

The nozzle openings 114 (FIG. 2) that are provided in the platform 68, 70 include a sufficiently large opening size to permit the unimpeded flow of water under pressure through the nozzles 138 that are disposed on the floor 56 and through the nozzle openings 114. The water is forced upward from the floor-mounted nozzles 138 in a spray pattern where the water contacts the underside of the shopping cart 54. Each of the branch circuits 118, 120, 122 includes a cap 144 at an end thereof to ensure that the only exit path for the water from the interior plumbing system 116 is through the nozzles 138.

The pressurized water exits all of the nozzles 138 under pressure and contacts the shopping cart 54 and an interior of the wash chamber 14 with sufficient force and coverage to clean the shopping cart 54 during the second stage of the wash cycle 4 and with sufficient force and coverage to rinse the cart during the second stage of the rinse cycle 8.

As the water is being discharged from the nozzles 138 under pressure, it continues to flow and drip downward off of the shopping cart 54, upper ceiling panel 50, left and right sidewall panels 44, 46, rear sidewall panel 52, and downward along an inside surfaces of the front sidewall panel 48 and the main door 12. The water passes through the drain holes 112 in the platform 68, 70 and also through a series of door ledge holes 146 that are provided through the lower door lip 72 that is under the main door 12. The door ledge holes 146 direct the water into the basin 84 and help prevent an accumulation of water from occurring under the main door 12 that could otherwise flow toward the opposite lower corners of the main door 12 and possibly leak out of the cart washer 10.

A lower lip (see Appendix 16) acts as a door splash-guard and is attached above a bottom of the main door 12 to an interior side of the main door 12 where it extends across the width of the main door 12 and helps to direct the downward flow of water inward and away from the main door 12. The flow of water continues downward where it reenters the basin 84 and sump 110 during the second stage of the wash cycle 4 and the second stage of the rinse cycle 8.

This creates a circulation of water that can occur indefinitely during the second stage of the wash cycle 4 and the second stage of the rinse cycle 8 providing that a sufficient quantity of water is initially provided in the sump 110 and basin 84. The cart washer 10 has been shown to function well with 2.5 gallons of water. This is because a sufficient quantity of water is able to return and keep the sump 110 replenished with water during either the second stage of the wash cycle 4 or the second stage of the rinse cycle 8 before a loss of prime can occur. This is due to the design of all components used and also to the design of the floor 56.

A loss of prime is undesirable because it would also cause a resultant break in the continuity of flow of water through the interior plumbing system 116. This would create noise and vibration which are not associated with the functioning of a quality machine. Operating without prime (i.e., water flowing) is also potentially damaging to the first impeller pump 126. The floor 56 of the wash chamber 14 also functions as the floor 56 of the basin 84 and, when the cart washer 10 is level, the floor 56 slopes rearward and generally toward the sump 110 to direct the return of water into the sump 110. This is why it is important to properly level the cart washer 10 prior to use.

Therefore, the sump 110 remains filled during the second stage of the wash cycle 4 and the second stage of the rinse cycle 8 which further helps prevent the first impeller pump 126 from losing its prime. The sump 110 includes a generally rectangular opening with four sump sides and a sump bottom. The sump bottom is recessed with respect to the floor 56 (i.e., the sump bottom is disposed closer toward the ground surface 62 than is the floor 56). The fluid capacity of the sump 110 is approximately equal to one gallon.

During normal operation of the first stage of the wash cycle 3, an adjustable first bellows pump 148 (FIG. 16) draws a predetermined quantity of wash detergent from the wash detergent container 102 that is contained in the upper chamber 90. This is described in greater detail hereinafter. A preferred first bellows pump is manufactured by IWAKI MODEL NUMBER WMD 114 R40. The wash detergent flows through a wash detergent hose 150 that extends down through a shelf opening 152 provided in the shelf 94 separating the upper chamber 90 from the lower chamber 92. The wash detergent hose 150 is attached to a side of a wash discharge fitting 154 (FIG. 11) that is disposed in an interior of the lower chamber 92. The wash detergent passes through the wash discharge fitting 154 and is discharged through a wash detergent fitting outlet 156 (FIG. 2) that is provided above the platform 68, 70.

The wash detergent flows downward and mingles with a first quantity of water that is simultaneously accumulating in the basin 84 and sump 110 during the first stage of the wash cycle 3. The accumulation of water during the first stage of the wash cycle 3 (and during the first stage of the rinse cycle 7) is described in greater detail hereinafter. The wash detergent combines with the first quantity of water in the sump 110 and basin 84 during the first stage of the wash cycle 3 and also during the second stage of the wash cycle 4.

When the cart washer 10 is operated in the automatic mode, after a sufficient amount of water (i.e., the first quantity of water) has accumulated in the sump 110 and the basin 84 (i.e., after completion of the first stage of the wash cycle 3), the first impeller pump 126 is energized for a predetermined period of wash time during the second stage of the wash cycle 4. The timing is discussed in greater detail hereinafter. The duration of the second stage of the wash cycle 4 is equal to the time that the first impeller pump 126 is energized.

During the second stage of the wash cycle 4, the first quantity of water and the wash detergent (in solution) are forced through the interior plumbing system 116 for a period of time sufficient to wash the shopping cart 54. This is discussed in greater detail hereinafter. After completion of the second stage of the wash cycle 4 the wash cycle 2 is completed. At that time in automatic mode (in manual mode a user accomplishes each stage of each cycle by manually actuating a particular manual switch), a second impeller pump 158 (FIG. 11) functions as a drain pump and is energized for a first drain cycle 5 (FIG. 8) that includes a desired period of time which is sufficient to drain the first quantity of water (with wash detergent) that has accumulated in the sump 110 and basin 84 through a drain intake opening 160 (FIG. 4) that is provided near the bottom of the sump 110.

Setting of this time is described in greater detail hereinafter. The second impeller pump 158 draws the water from the sump 110 through the drain intake opening 160, through an intake drain hose 162 (FIG. 11), into an intake drain port 158*a*, out a drain discharge port 158*b*, through a drain pressure supply hose 164 that connects to an upper drain outlet 166 (FIG. 10) where an upper garden drain hose (not shown) is connected. The second impeller pump 158 forces the water through the upper drain outlet 166 and out of the cart washer 10 through the detachable upper garden drain hose to a drain that is disposed away from the cart washer 10 and which may be elevated above the cart washer 10 or below it.

Figure 7:
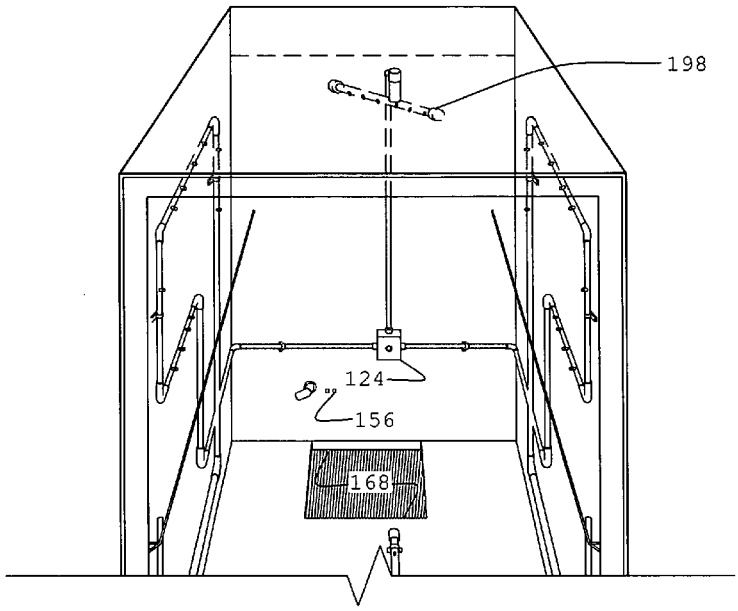
FIG. 7 is a front view in perspective of the cart washer of FIG. 3 with a more elevated view to show a rotating bar attached to a ceiling of a wash chamber.

Very fine dirt or debris that is in solution or mixture with the water is also drained. A removable filter screen 168 (FIG. 7) is disposed over the sump 110 during normal use. The filter screen 168 is used to prevent the entry of dirt, sediments, or objects that may be contained in the shopping cart 54 from being washed off of the shopping cart 54 and reaching the sump 110 where they could be drawn into the interior plumbing system 116 and impede operation if they are too large in size to pass through the nozzles 138. The filter screen 168 is periodically removed and cleaned or eventually replaced.

The duration of the second stage of the wash cycle 4 is a variable and can be varied to suit the needs of each user of the cart washer 10. After completion of the first drain cycle 5 by the second impeller pump 158, an adjustable second bellows pump 170 (same preferred type as the first bellows pump 148) similarly draws a predetermined quantity of rinse solution from the rinse solution container 104 that is disposed in the upper chamber 90.

The rinse solution flows through a rinse chemical hose 172 that extends down through the shelf opening 152. The rinse chemical hose 172 is attached to a side of a rinse discharge fitting 174 that is disposed in an interior of the lower chamber 92 adjacent to the wash discharge fitting 154. The rinse solution passes through the rinse discharge fitting 174 and is discharged through a rinse solution fitting outlet 176 (FIG. 2) that is provided above the platform 68, 70.

The rinse solution flows downward and mingles with a second quantity of water that is simultaneously accumulating in the basin 84 and sump 110 during the first stage of the rinse cycle 7. The rinse solution further combines with the second quantity of water in the sump 110 and basin 84 during the first and second stages of the rinse cycle 7, 8. After a sufficient amount of water has accumulated in the sump 110 and basin 84, the first impeller pump 126 is again energized for a predetermined period of time that is equal to the total time of the second stage of the rinse cycle 8.

During the second stage of the rinse cycle 8, the second quantity of water and the rinse solution (in solution) are forced through the interior plumbing system 116 for a period of time sufficient to rinse the shopping cart 54 so that it is clean. After completion of all of the rinse cycle 6, the second type of impeller pump 158 is again energized for a period of time sufficient to drain the second quantity of water (with rinse solution) from the cart washer 10.

The shopping cart 54 is now ready to be removed from the wash chamber 14 of the cart washer 10 and another shopping cart 54 can be placed in the wash chamber 14 to repeat the process for as many shopping carts 54 as need to be washed. The main door 12 is opened and the cleaned shopping cart 54 therein is removed by urging it outward and down the ramp 58. The next shopping cart 54 that is to be washed is then urged up the ramp 58 and into the wash chamber 14 and the process is repeated.

It is important to note that the path up the ramp 58 and into the main chamber 14 is smooth and does not include passage of the shopping cart 54 over ledges, steps, or any conduit.

As previously mentioned, the cleaning process may include either automatic or manual modes of operation for the cart washer 10 and they are described in greater detail hereinafter. The amount of fresh water entering the sump 110 and basin 84 are determined by controlling the amount of time that a fill solenoid 178 (FIG. 11), which is used to open and close a fill valve 180, is allowed to remain open during the first stage of the wash cycle 3 and the first stage of the rinse cycle 7. Dip switches 182 on the circuit board 134 (FIG. 16) are used to select the desired time for the first stages of the wash and rinse cycles 3, 7. The time is based on the available water pressure at an inlet port 184 (FIG. 10) and on the amount of water that is desired.

Typically, the dip switches 182 are set according to installation instructions to set the time that the fill solenoid 178 will hold open the fill valve 180 for the first stage of the wash cycle 3 (and first stage of the rinse cycle 7) until approximately 2.5 gallons of fresh water are able to enter the basin 84 and sump 110 as the first quantity of water. Of course, the amount of water can be varied, as desired.

During the first fifteen seconds of the first stage of the wash cycle 3, the first bellows pump 148 is also energized. A variable drive gear setting of the first bellows pump 148 is set to vary a number of revolutions that occur in the first bellows pump 148 during the fifteen seconds that it is energized. This, in turn, varies an amount of compression that is applied to urge the wash detergent out of the wash detergent container 102. In this way, the quantity of wash detergent dispensed for use in the wash cycle 2 is varied according to the amount of water that is used for the first quantity of water and for the particular cleaning needs of each user, which can vary widely.

A typical fill time for use with typical inlet water pressure is approximately 45 seconds in order to accumulate 2.5 gallons. Therefore, a typical overall time for the first stage of the wash cycle 3 is about 45 seconds. It is important to note that the first bellows pump 148 is energized during the first one-third, or the first fifteen seconds only, of the total 45 seconds of time allotted for the first stage of the wash cycle 3. The second stage of the wash cycle 4 typically runs for about 75 seconds during which the first quantity of water and the wash detergent are sprayed on the shopping cart 54 that has been placed in the wash chamber 14.

It is also useful to note that the main door 12 includes a door sensor switch, either in the frame or located elsewhere, that requires the main door 12 to be closed to operate the cart washer 10. A preferred way of sensing door closure is the use of a magnetically actuated proximity switch and a magnet attached to an interior of the main door 12 whereby the magnetically actuated proximity switch is actuated (opened or closed) only when the main door 12 is in a fully closed position. Opening of the main door 12 during operation will immediately cause the cart washer 10 to stop operating.

Accordingly, the entire wash cycle 2 takes about two minutes to complete for most applications when the cart washer 10 is in the automatic mode. After completion of the wash cycle 2, the second impeller pump 158 is energized for a first drain cycle 5 with a period of time that is sufficient to drain the first quantity of water out of the cart washer 10. This time is also set by the dip switches 182. Similarly, the dip switch 182 setting regulates the duration that the fill solenoid 178 is energized to keep the fill valve 180 open during the first stage of the rinse cycle 7.

The same bank of dip switches 182 that were used to set the duration of the first stage of the wash cycle 3 can also be used to set the duration of the first stage of the rinse cycle 7. The dip switches 182 are used to set the duration of the first drain cycle 5 and of a second drain cycle 9 (which are typically the same in duration because the same quantity of water is typically, but not necessarily, used for both the wash cycle 2 and the rinse cycle 6). Either the same or different dip switches 182 can also be used to set each of the various times independently with respect to one-another.

This is because the computer 132 is able to read the same or, if preferred, different dip switches 182 and assign any desired time to any of the dip switches 182 for any of the operations of the cart washer 10. Approximately 2.5 gallons of fresh water are used as the second quantity of water during the rinse cycle 6 for a total water consumption of approximately 5 gallons per shopping cart 54 that is washed. During the first stage of the rinse cycle 7 which last approximately 45 seconds, the second bellows pump 170 is energized for the first fifteen seconds. The second bellows pump 170 is set to draw in the desired amount of rinse solution.

A duration that the second impeller pump 158 (i.e., the drain pump) is activated is also controlled by the computer 132 and the position of the dip switches 182. The computer 132 controls all operations of the cart washer 10 and allows for switching between automatic and manual cleaning cycles (or modes of operation).

The first and second impeller pumps 126, 158 are disposed in the lower chamber 92. The first and second bellows pumps 148, 170 are disposed in the upper chamber 90. The time for the first stage of the wash cycle 3, the first stage of the rinse cycle 7, the second stage of the wash cycle 4, the second stage of the rinse cycle 8, and for each of the two drain cycles 5, 9 are variable and can be set as desired for operation of the cart washer 10 in the automatic or manual modes.

However, once the automatic mode is actuated by pulling outward a control knob 186 (FIG. 14) on the automatic mode control panel 32, the cart washer 10 will automatically cycle through and complete every aspect of washing of the shopping cart 54. This is discussed in greater detail below. However, when the cart washer 10 is in the manual mode, each specific operation must be accomplished by the user pressing either the manual fill button 85, a manual drain button 188, or a manual wash button 190 located on the manual mode control panel 38.

The automatic mode is set to clean most typical shopping carts 54 in the shortest average time and with the least amount of wash detergent, rinse solution, and water possible for both the first and second quantities of water. The manual mode can be used to expedite the cleaning of shopping carts 54 that are very clean to start with (as determined by the user) or to permit the thorough cleaning of shopping carts 54 that are especially dirty. For exceptionally dirty shopping carts 54 with accumulated debris, cleaning tools (i.e., brushes) and instructions may be provided for optional "pre-cleaning" of exceptionally dirty shopping carts 54 before cleaning by the cart washer 10.

During automatic operation of the cart washer 10, each step is automatically cycled through in accordance with computer 132 control and the dip switch 182 settings as shown in FIG. 8. After activating the automatic mode by the user pulling the control knob 186 outward, the first stage of the wash cycle 3 is activated and the basin 84 and sump 110 fill with the first quantity of water and the wash detergent. After completion of the first stage of the wash cycle 3, the cart washer 10 will automatically cycle to and complete the second stage of the wash cycle 4 when in the automatic mode. The cart washer will then automatically cycle to and complete the first drain cycle 5 to drain out the first quantity of water and wash detergent that were used to wash the shopping cart 54 and then it will cycle to the first stage of the rinse cycle 7 to fill the basin 84 and sump 110 with the second quantity of water and rinse solution. The cart washer 10 will then automatically cycle and complete the second stage of the rinse cycle 8. After completion of the second stage of the rinse cycle 8, the cart washer 10 will cycle to and complete the second drain cycle 9 to drain out the second quantity of water and rinse solution that were used to rinse the shopping cart 54. A first cleaning indicator light 192 disposed by the automatic mode control panel 32 is illuminated while the cart washer 10 is in operation in the automatic mode. It shuts off to indicate that the shopping cart 54 has been washed and can now be removed.

Wiring cables extend from the rear compartment 20 to the automatic mode control panel 32 and to the manual mode control panel 38 and also carry the signal from the magnetically actuated proximity switch. The wiring cables include waterproof covering and all connections to components within the wash chamber 14 are also waterproof.

A detachable inlet garden hose (not shown) is used to supply fresh water under pressure to the inlet port 184. If the inlet port 184 is connected to hot water, then hot water is used to wash and clean the shopping cart 54. If hot water is used steam can occur in the wash chamber 14. The steam is vented out of the wash chamber 14 by a pair of vents 194, 196 (FIG. 10) that are disposed at a top of the rear sidewall panel 52 of the wash chamber 14. A splash-guard is attached to an interior of the rear sidewall panel 52 in a parallel and spaced-apart orientation with respect to each of the pair of vents 194, 196. Each splash-guard is disposed typically less than an inch away from an interior of the rear sidewall panel 52. Accordingly, steam is able to vent out of the pair of vents 194, 196 whereas water that is being sprayed on the shopping cart 54 is prevented from splashing out and escaping through the pair of vents 194, 196. The water is, thereby, retained in the wash chamber 14.

A rotating bar 198 (FIG. 7, 9) with nozzles 138 is attached to an interior of the wash chamber 14 of the upper ceiling panel 50 as part of the interior plumbing system 116. The rotating bar 198 rotates about a center thereof on a swivel joint 200 that is attached to the upper ceiling panel 50. The rotating bar 198 includes a longitudinal axis that is parallel with respect to a plane of the upper ceiling panel 50. The rotating bar 198 is disposed slightly below the upper ceiling panel 50 and it rotates whenever fluid under pressure is flowing through the interior plumbing system 116.

This occurs because at least one of the nozzles 138 that are attached to a first side of the rotating bar 198 is disposed at an angle that is offset approximately 45 degrees upward from plumb and because at least one of the nozzles 138 that are attached to an opposite second side of the rotating bar 198 is similarly offset approximately 45 degrees from plumb but in an opposite direction with respect to the (at lease one) nozzle 138 disposed on the first side. Due to Newton's third law of motion when water is flowing through the rotating bar 198, the positioning of the (at least one) nozzle 138 on both sides of the rotating bar 198 combine to produce an overall force vector that includes a horizontal component sufficient to rotate each side of the rotating bar 198 in a direction that is opposite that of the horizontal discharge direction (i.e., horizontal vector component) of the water.

In the unlikely event a hose breakage were to occur in the lower chamber 92, the water would flow through openings in a floor plate 202 (FIG. 11) and the level would not rise to reach the first or second impeller pumps 126, 158.

Side vents 204 are provided in the lower chamber 92 and are intended to keep the first and second impeller pumps 126, 158 cool even with the rear door 88 and the side door 98 closed over extending periods of time.

The position of left guard rail 76 and the right guard rail 78 are adjustable to accommodate the size of shopping cart 54. Similarly, the position of the left cart stop strip 80 and the right cart stop strip 82 are adjustable to accommodate different locations for front wheel 54*a* as used on different types of the shopping cart 54.

An unexpected benefit is also provided by the cart washer 10. If desired, a rack is placed in the basket portion of the shopping cart 54 and is used to hold several hand baskets (what people in grocery stores use when only a few items are needed). The cart washer 10 will then clean the shopping cart 54 and the hand baskets at same time.

Figure 16:
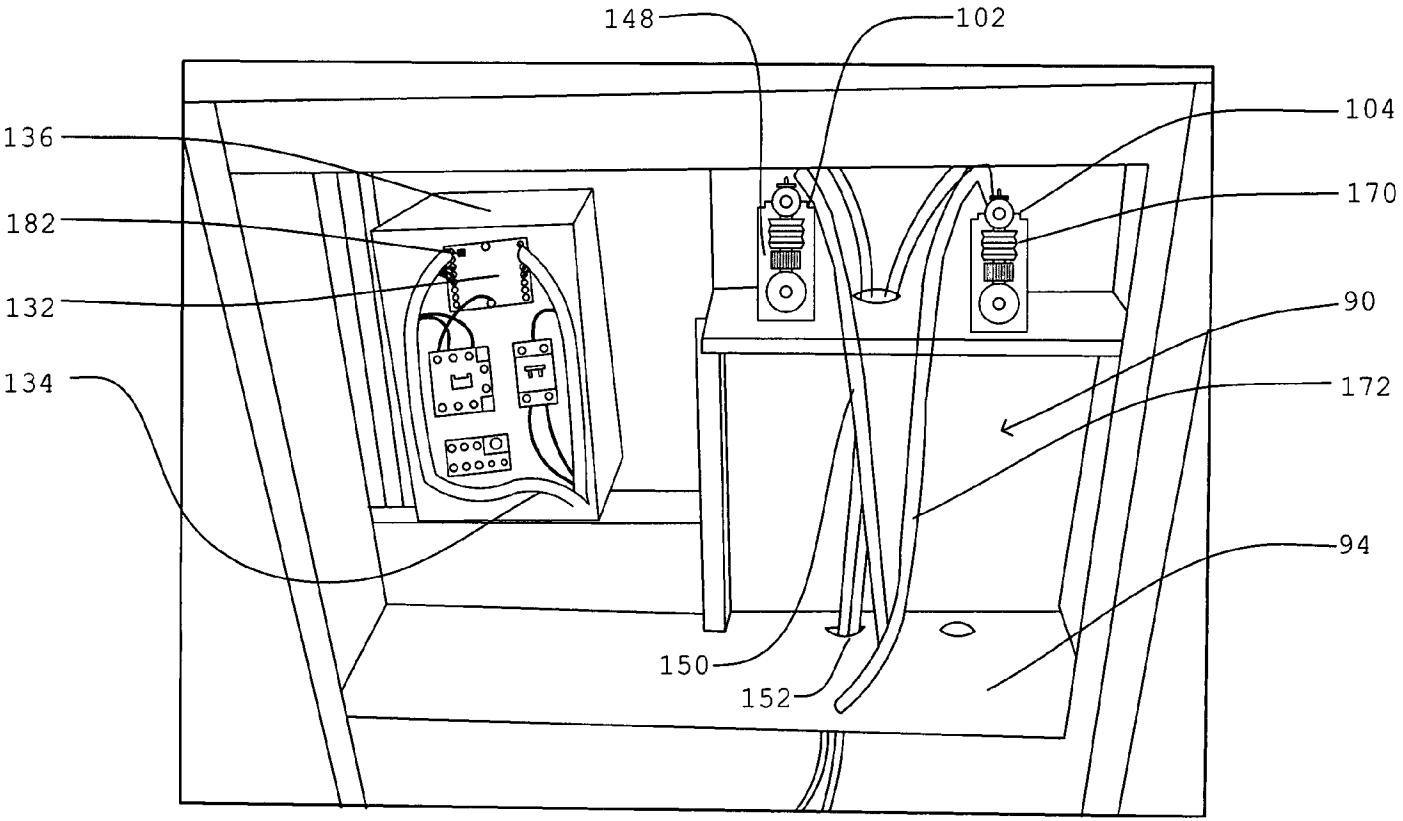
FIG. 16 is a rear view in perspective of an upper chamber of the cart washer of FIG. 1.

Referring to FIG. 8 is shown a flow chart of an executive operating system of the cart washer 10. The executive operating system represents one possible embodiment of software (and or firmware) that is written to control the functioning of the computer 132 that is included in the electrical panel 136 (FIG. 16). Wiring extends from the electrical panel 136 and is used to sense when the main door 12 is closed and to control every electrical component of the cart washer 10. The dip switches 182 are disposed on the circuit board 134 that is contained in the electrical panel 136.

Appendix 1 provides instructions for operating the cart washer 10. Appendices 2-9 are not included. Appendices 10-13 provide additional detail regarding assembly of subsystems and larger component assemblies of the cart washer 10. Appendices 14-20, 22-28, 30-32 provide additional detail regarding component parts of the cart washer 10. Appendix 21 includes detail of a preferred layout of the interior plumbing system. Appendix 29 includes detail of the rear compartment 20 with the rear door 88 removed except that the currently preferred manufacturer and model number for the first impeller pump 126 is different than as shown in appendix 29. It is also noted that the rear compartment 20 includes the upper chamber 92 and the lower chamber 90. Appendix 33 provides a wiring/electrical diagram of the cart washer 10. Appendix 34 provides specifications of the computer 132 of the cart washer 10. The computer 132 chip is manufactured by AIR-O-TRONICS, part number MC1002775KlH. Appendix 35 provides a table that equates to the duration the fill valve 180 is maintained in an open position by the fill solenoid 178 depending in accordance with how the dip switches 182 are set. Appendix 36 provides a timing diagram that represents relative actuation times for the primary electrical components of the cart washer 10. As shown in appendix 36 the water valve is the fill valve 180, the main pump is the first impeller pump 126, the drain pump is the second impeller pump 158, the detergent pump is the first bellows pump 148, and the disinfectant pump is the second bellows pump 170. Some of the names used to describe certain component parts of the cart washer 10 that appear in the appendices differ from those that are used in the preceding text.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to these various needs, some of which may be long-standing in nature, the instant invention further attests that the elements thereof, in combination as claimed, cannot be obvious in light of the teachings of the prior art.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for cart cleaning, comprising:

disposing a shopping cart above a common wash and rinse basin within a wash chamber;

filling the common wash and rinse basin with a quantity of water, the common wash and rinse basin comprising a sump such that the quantity of water is sufficient for a wash cycle and is sufficient for a rinse cycle;

supplying a quantity of wash detergent to the common wash and rinse basin with a first bellows pump;

washing the shopping cart with the mixed water and wash detergent from the common wash and rinse basin during a first period of time;

supplying a quantity of rinse chemical to the common wash and rinse basin with a second bellows pump;

rinsing the shopping cart with the mixed water and rinse chemical from the common wash and rinse basin during a second period of time; and draining the common wash and rinse basin during a third period of time.

2. The method of claim 1, wherein the first bellows pump is operatively coupled with a variable drive gear such that the quantity of said wash detergent supplied by the first bellows pump is based at least in part on a setting of the variable drive gear.

3. The method of claim 2, wherein the setting of the variable drive gear corresponds to a number of revolutions of the variable drive gear during a time period.

4. The method of claim 3, wherein supplying the quantity of wash detergent to the common wash and rinse basin with the first bellows pump comprises rotating the variable drive gear operatively coupled to the first bellows pump.

5. The method of claim 1, wherein washing the shopping cart with the mixed water and wash detergent from the common wash and rinse basin during the first period of time comprises rotating a rotating nozzle bar at least in part by urging the mixed water and wash detergent from the common wash and rinse basin through at least one nozzle of the rotating nozzle bar that is disposed at an angle other than plumb.

6. The method of claim 5, wherein rinsing the shopping cart with the mixed water and rinse chemical from the common wash and rinse basin during the second period of time comprises rotating the rotating nozzle bar at least in part by urging the mixed water and rinse chemical from the common wash and rinse basin through the at least one nozzle of the rotating nozzle bar that is disposed at an angle other than plumb.

* * * * *

UNITED STATES PATENT AND TRADEMARK OFFICE

CERTIFICATE OF CORRECTION

PATENT NO. : 8,480,814 B1
APPLICATION NO. : 13/199087
DATED : July 9, 2013
INVENTOR(S) : John Dimitrios Fanourgiakis et al.

It is certified that error appears in the above-identified patent and that said Letters Patent is hereby corrected as shown below:

Title Page, after Abstract and before Drawings insert Appendix attached.

Signed and Sealed this
Twelfth Day of August, 2014

Michelle K. Lee

Michelle K. Lee
*Deputy Director of the United States Patent and Trademark Office*

Appendix 1

Operating Instructions

For Cart Washer

Electrical System:

1. Power Supply: This appliance must be supplied with 115V and connected to an individual, properly grounded branch circuit, protected by a 15-ampere circuit breaker.

2. Power-Cord Protection: The CCS3000 is equipped with a power-supply cord. Power supply cords should be secured so that they are not walked upon or pinched by other items. Please pay special attention to the power cord at the electrical outlet and/or near the machine.

3. Overloading of CCS3000: In order to ensure that this instrument functions properly, is recommended that no other electrical device be connected to the same outlet.

OPERATION OF CCS3000

1. Startup

Step 1: (Leveling of CCS3000): Prior to commencing the wash cycle make sure the machine is in a level location.

Step 2: (Water Inlet Connection): Take the water supply hose and connect it to the fill valve.

Step 3: (Water Outlet Connection): Take the drainage hose and connect from the drain outlet (store) to the drain outlet located on the CCS3000.

Step 4: (Connection the Power Supply): Take the power cord and connect to a 115V electrical outlet.

Step 5: (Preparation of Cleaning Detergent): Open the rear door. Take the cleaning detergent hoses marked "Wash" and "Rinse" and insert them in their corresponding detergent containers marked "Wash" and "Rinse."

2. Cleaning Preparation

Step 1: (Debris Removal): Remove any debris located in the shopping cart.

Step 2: (Pre-wash Scrub- As Needed): Using the Clean Cart Systems scrubbing tools, remove any heavy residue from the shopping carts.

Step 3: (Ramp Preparation): Lower the ramp to a resting position.

Step 4: (Insertion of Cart): Insert the shopping cart so that it is entirely within the machine.

Step 5: (Door Close): Close the front door.

3. Cleaning Phase: The CCS3000 is equipped to perform two alternative methods of cleaning.

Automatic Cleaning Function
Pull the big black button (mushroom switch). The Cleaning Indicator Light will signal that the machine has begun its washing cycle. After approximately two minutes, the washing cycle will end. The cycle then begins and lasts for approximately two minutes. At the conclusion of the rinse cycle, the Cleaning Indicator Light turns off indicating the cart has been cleaned and is ready for removal. The CCS3000 will automatically drain the water and detergent after use.

Manual Cleaning Function
Push the button labeled "Fill". The CCS3000 is pre-programmed to fill with the correct amount of water and cleaning detergent. After approximately 45 seconds, the CCS3000 will finish pre-filling and the fill light will turn off.

Push the button labeled "Wash". The Cleaning Indicator Light will signal that the machine has begun its washing cycle. At the conclusion of the wash cycle (approximately 20 seconds), the Cleaning Indicator Light turns off indicating the cart has been cleaned and is ready for removal.

Push the button labeled "Drain". The CCS3000 will then perform the draining phase, collecting all water and detergent after use.

4. Shutdown Phase

Step 1: (Disconnect the Power Supply): Take the power cord and disconnect it from the 115V electrical outlet.

Step 2: (Floor Screen Cleaning - As Necessary): Inspect the floor screen for debris and/or sediment. The floor screens are detachable and may be removed from the CCS3000. Remove debris and/or sediment as necessary.

Step 3: (Filter Screen Cleaning - As Necessary): Inspect the filter screen for debris and/or sediment. The filter screens are detachable and may be removed from the CCS3000. Remove debris and/or sediment as necessary.

Step 4: (Hose Removal - Optional): If the CCS3000 is moved for cart cleaning, disconnect the water intake and drain hoses from their connections.

Step 5: (Door Close): Close the front door of the CCS3000.

Warnings! Safety Precautions

- Do not store or use combustible or hazardous materials in the CCS3000
- This machine is not to be used for any other purpose than for cleaning of shopping carts and shopping baskets. This machine cannot be utilized for any other purpose without the express written consent of Clean Cart Systems.
- In order to avoid the risk of injury, humans or animals are expressly prohibited from occupying the inside of the machine.
- Do not use any other cleaning detergents in the CCS3000. Clean Carts Systems has designed and calibrated a special cleaning detergent for use with the machine. The use of any cleaning agents other than those furnished by Clean Cart Systems will result in damage to the machine.
- Please exercise caution around the CCS3000. Due to the use of water and cleaning agents the area may be slippery. Please utilize caution when working in the area of the CCS3000.
- For your safety, due to the stainless steel design (that absorbs heat), the CCS3000 must not be exposed to direct sunlight and/or any other direct heat source.
- Do not cut, remove, or bypass the grounding prong of the electrical plug (third prong)
- In order to ensure proper water circulation, please make sure that the CCS3000 is on a level surface during the operation.
- To keep the CCS3000 functioning properly, do not tamper with any internal mechanisms of the device without the expressed consent of Clean Cart Systems or their designated representatives.
- For proper functioning, please ensure that all hoses are free of any obstruction or kinking of the lines.

- Do not stand on the CCS3000 or place any objects on the CCS3000 without the approval of Clean Cart Systems.
- Do not attempt to lift the CCS3000.
- Only use attachments/ accessories specified by Clean Cart Systems.
- Please do not touch the steel surfaces if exposed to direct sunlight or direct heat source. Further, the steel surfaces may become hot due to the operation of the electrical system. This may result in the absorbing of too much heat and may result in burning if touched.

APPENDIX 10
SIDE VIEW
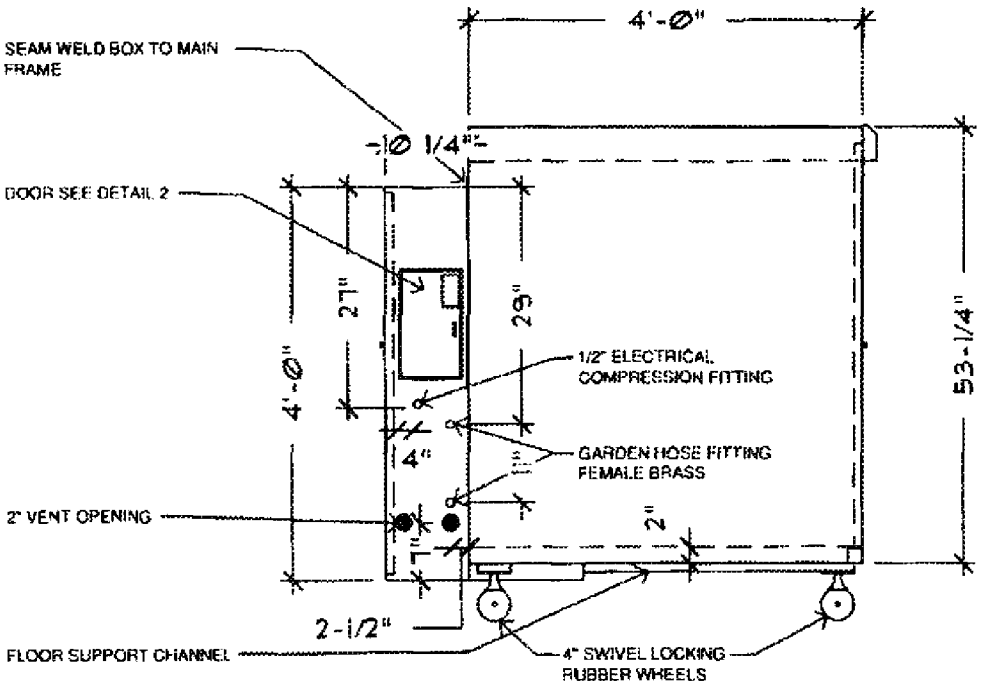

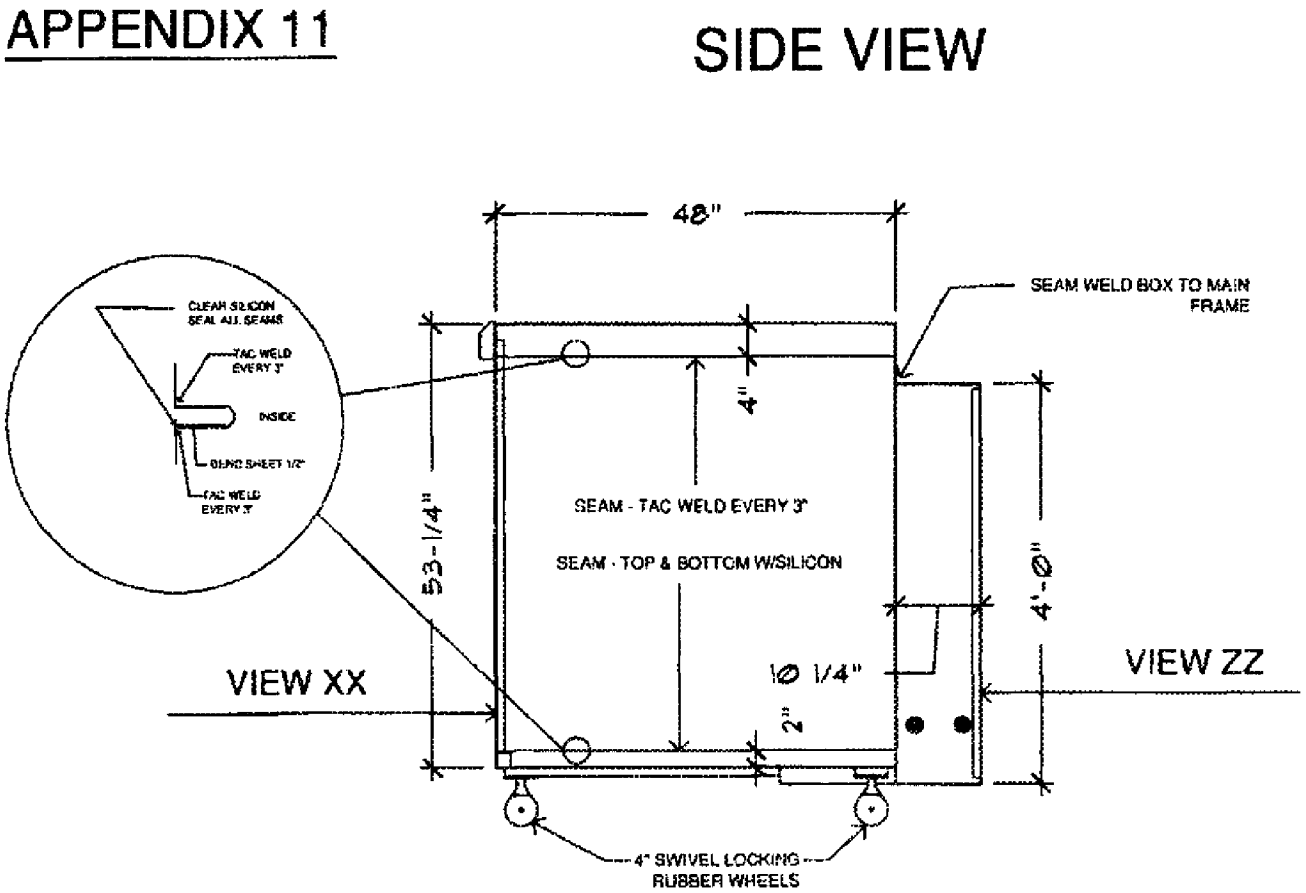
APPENDIX 11
SIDE VIEW
SEAM WELD BOX TO MAIN FRAME
VIEW ZZ
4'-0"
48"
4"
SEAM - TAC WELD EVERY 3"
SEAM - TOP & BOTTOM W/SILICON
10 1/4"
2"
4" SWIVEL LOCKING RUBBER WHEELS
53-1/4"
VIEW XX
CLEAN SILICON SEAL ALL SEAMS
TAC WELD EVERY 3"
INSIDE
BLANK SHEET 1/2"
TAC WELD EVERY 3"

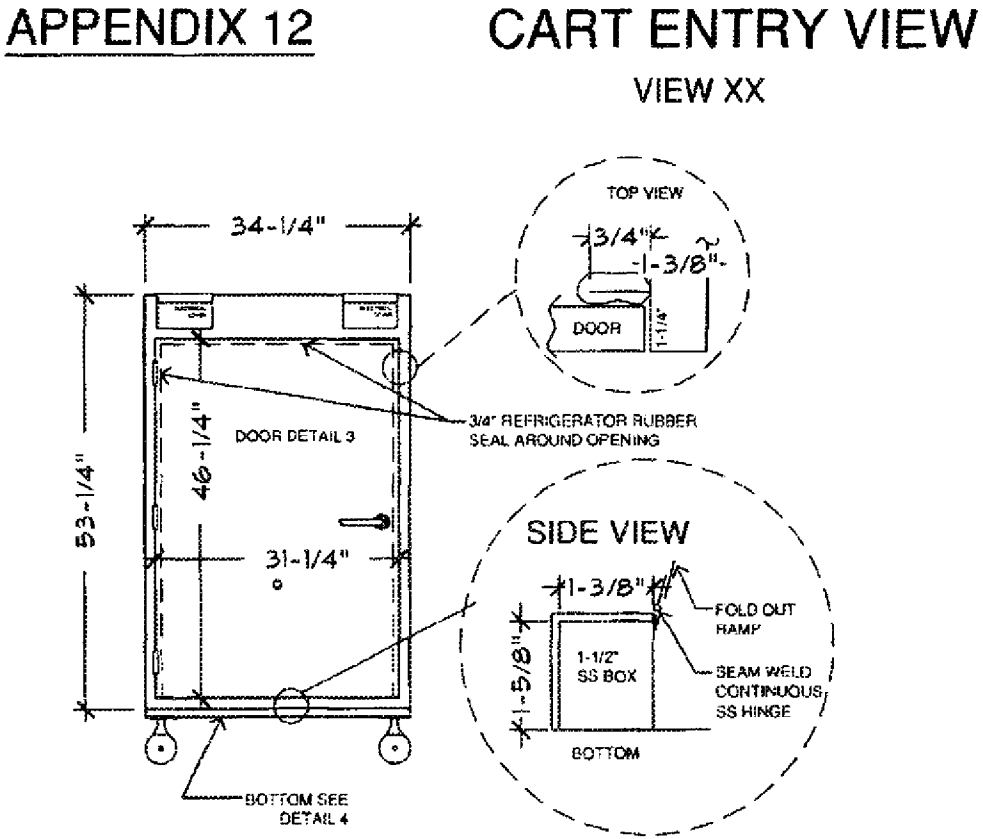
APPENDIX 12
CART ENTRY VIEW
VIEW XX
TOP VIEW
3/4"
1-3/8"
DOOR
3/4" REFRIGERATOR RUBBER SEAL AROUND OPENING
SIDE VIEW
FOLD OUT RAMP
SEAM WELD CONTINUOUS SS HINGE
1-3/8"
1-1/2" SS BOX
BOTTOM
1-5/8"
34-1/4"
DOOR DETAIL 3
31-1/4"
46-1/4"
53-1/4"
BOTTOM SEE DETAIL 4

APPENDIX 13
BOTTOM VIEW UNDER SIDE OF CART
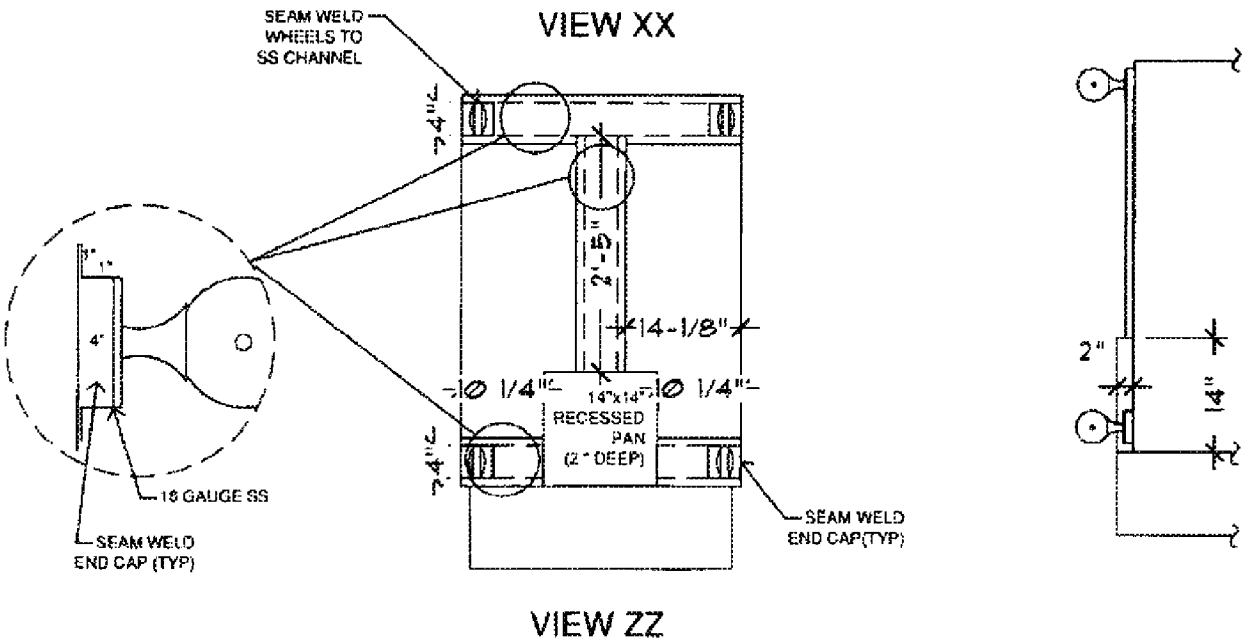

APPENDIX 14 DETAIL 1 - DOOR CONSTRUCTION
VIEW ZZ
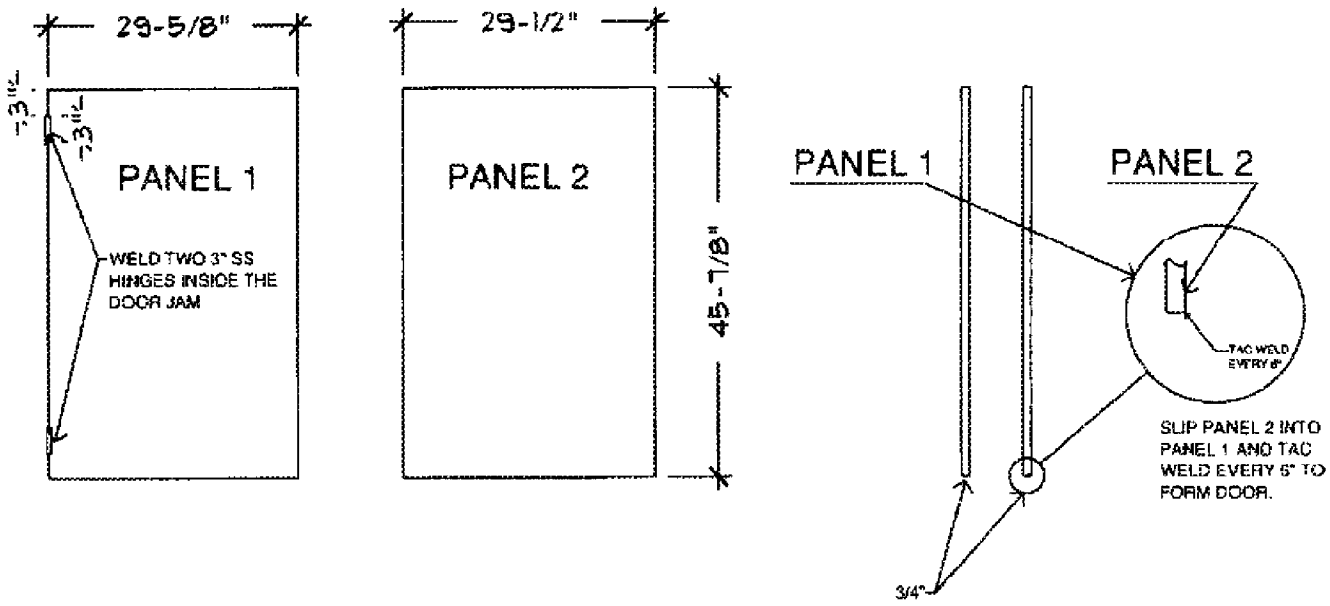

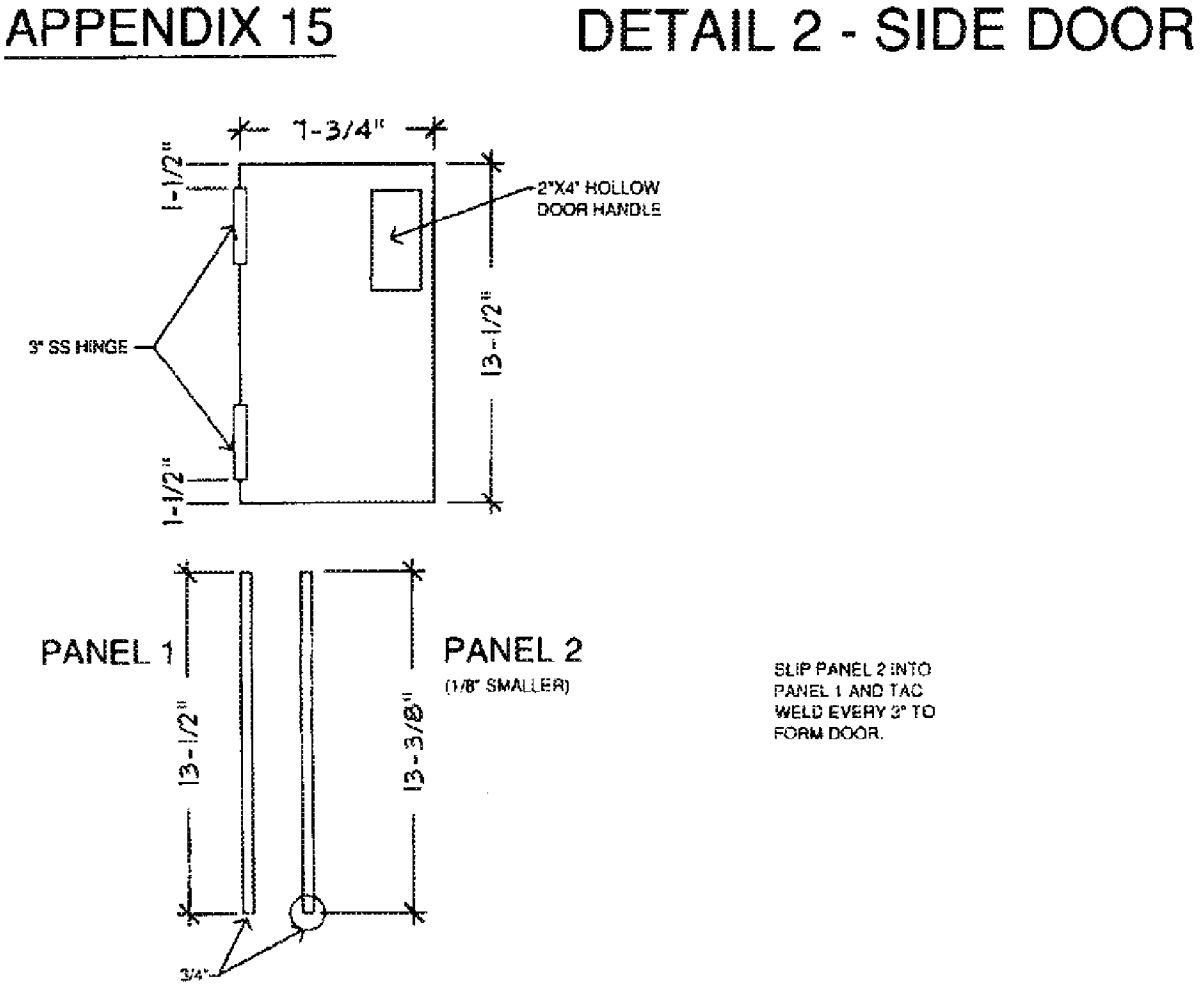
APPENDIX 15
DETAIL 2 - SIDE DOOR
2"X4" HOLLOW DOOR HANDLE
13-1/2"
7-3/4"
1-1/2"
1-1/2"
3" SS HINGE
SLIP PANEL 2 INTO PANEL 1 AND TAC WELD EVERY 3" TO FORM DOOR.
PANEL 2
(1/8" SMALLER)
13-3/8"
13-1/2"
PANEL 1
3/4"

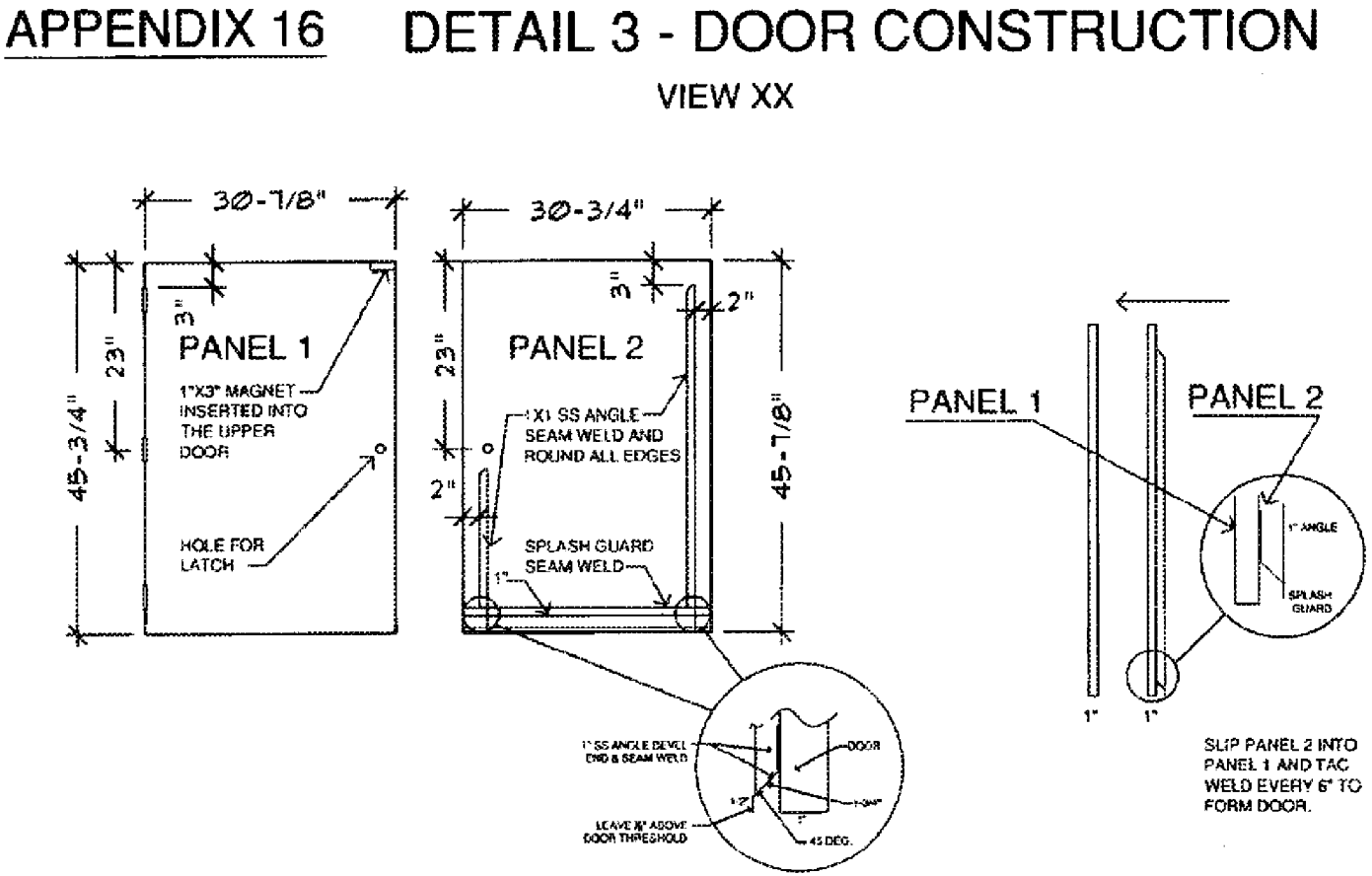
APPENDIX 16
DETAIL 3 - DOOR CONSTRUCTION
VIEW XX
PANEL 1
PANEL 2
1"X3" MAGNET INSERTED INTO THE UPPER DOOR
HOLE FOR LATCH
1"X1 SS ANGLE SEAM WELD AND ROUND ALL EDGES
SPLASH GUARD SEAM WELD
1" ANGLE
SPLASH GUARD
SLIP PANEL 2 INTO PANEL 1 AND TAC WELD EVERY 6" TO FORM DOOR.
DOOR
45 DEG.
1"SS ANGLE PENCIL END & SEAM WELD
LEAVE 1/4" ABOVE DOOR THRESHOLD
30-1/8"
45-3/4"
30-3/4"
45-7/8"
23"
3"
2"
1"

APPENDIX 17
FOLD OUT REAR RAMP
CART REAR ENTRY DOOR
VIEW XX
DOOR OFF
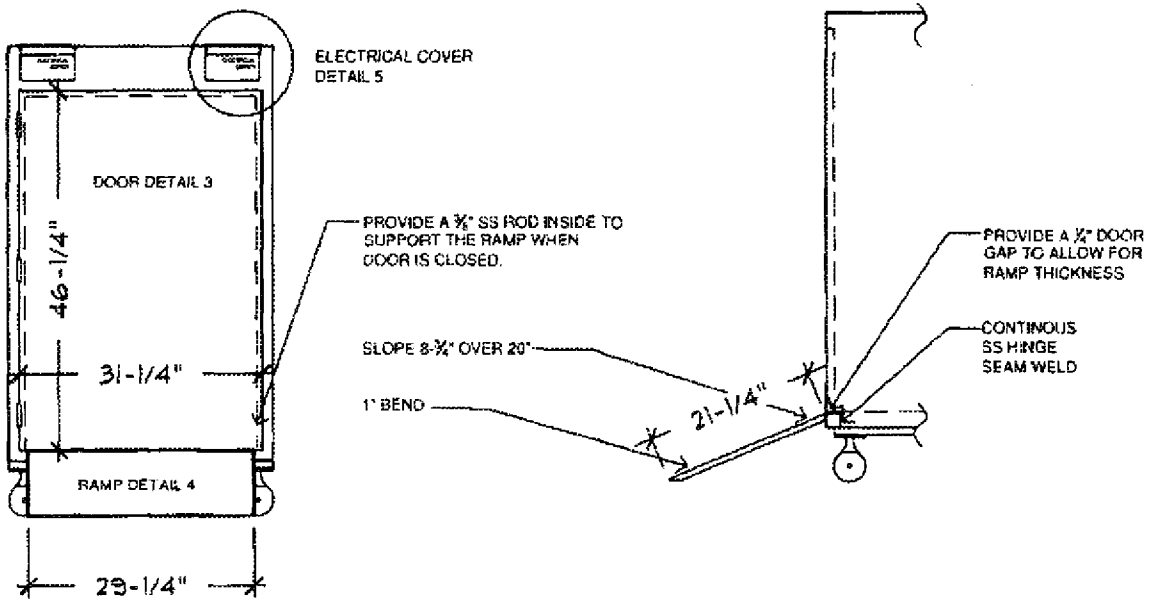
SIDE VIEW OF FOLD OUT RAMP

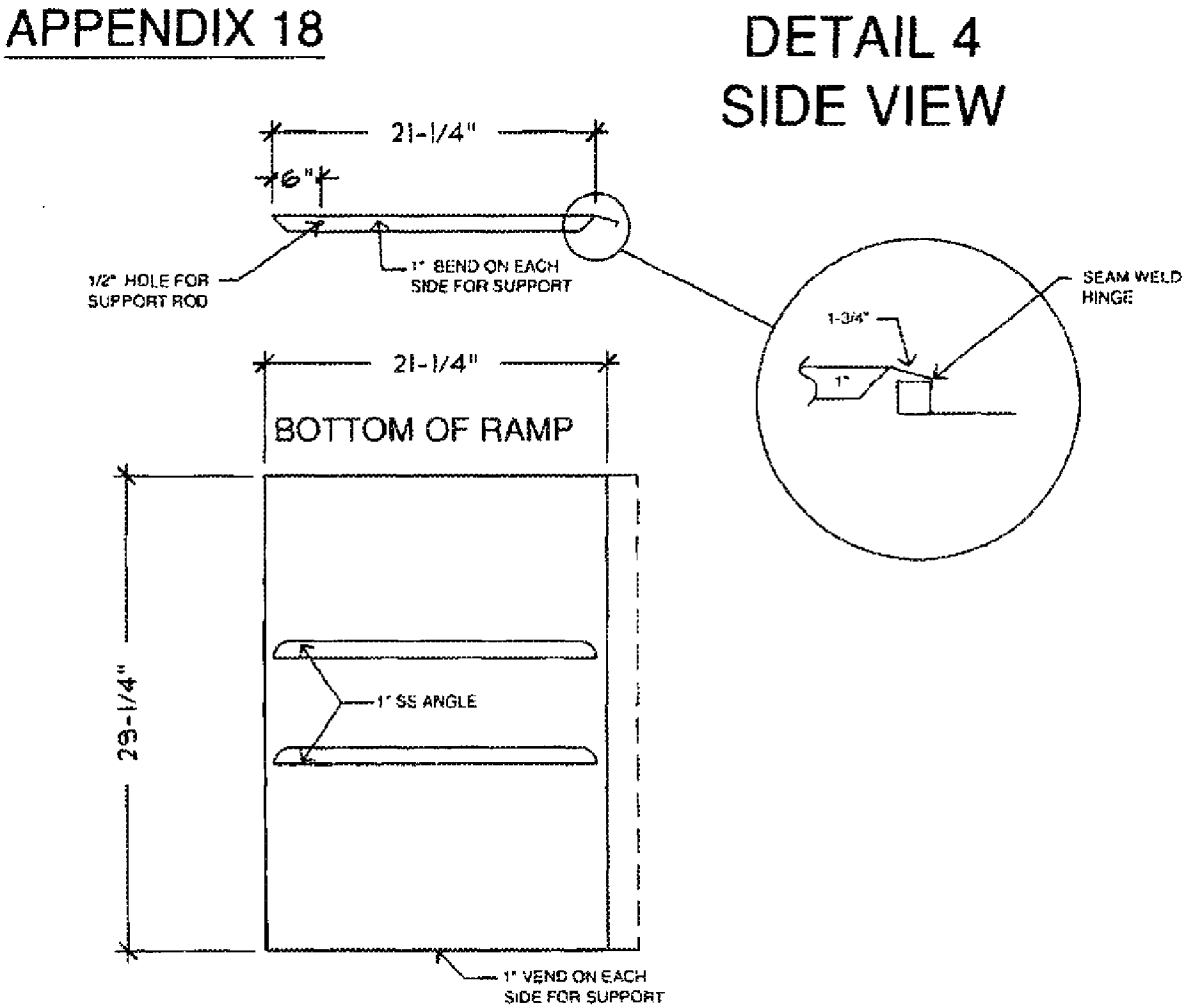
APPENDIX 18
DETAIL 4
SIDE VIEW
SEAM WELD HINGE
1-3/4"
1"
21-1/4"
6"
1" BEND ON EACH SIDE FOR SUPPORT
1/2" HOLE FOR SUPPORT ROD
21-1/4"
BOTTOM OF RAMP
1" SS ANGLE
1" BEND ON EACH SIDE FOR SUPPORT
29-1/4"

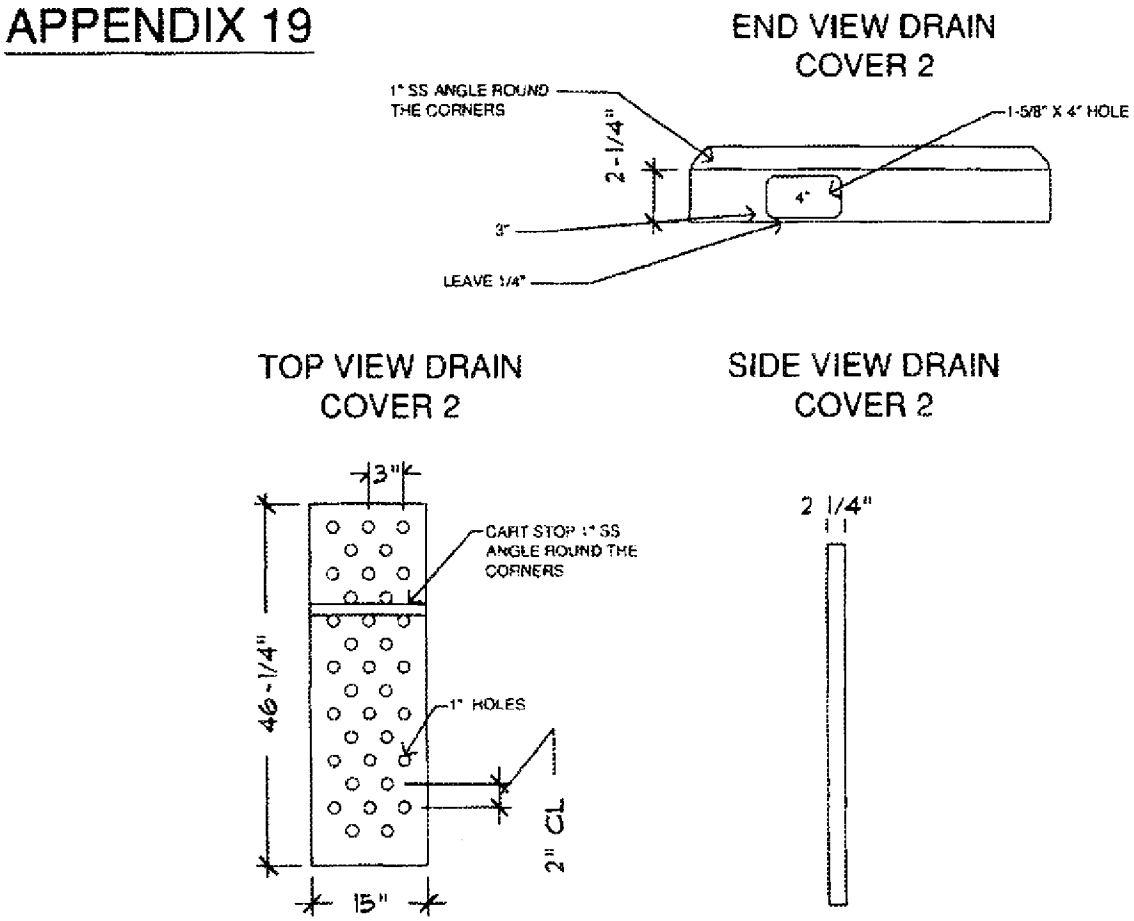
APPENDIX 19
END VIEW DRAIN COVER 2
1-5/8" X 4" HOLE
4"
2-1/4"
1" SS ANGLE ROUND THE CORNERS
2"
LEAVE 1/4"
SIDE VIEW DRAIN COVER 2
2 1/4"
TOP VIEW DRAIN COVER 2
CAPIT STOP 1" SS ANGLE ROUND THE CORNERS
1" HOLES
2" CL
3"
15"
46-1/4"

APPENDIX 20
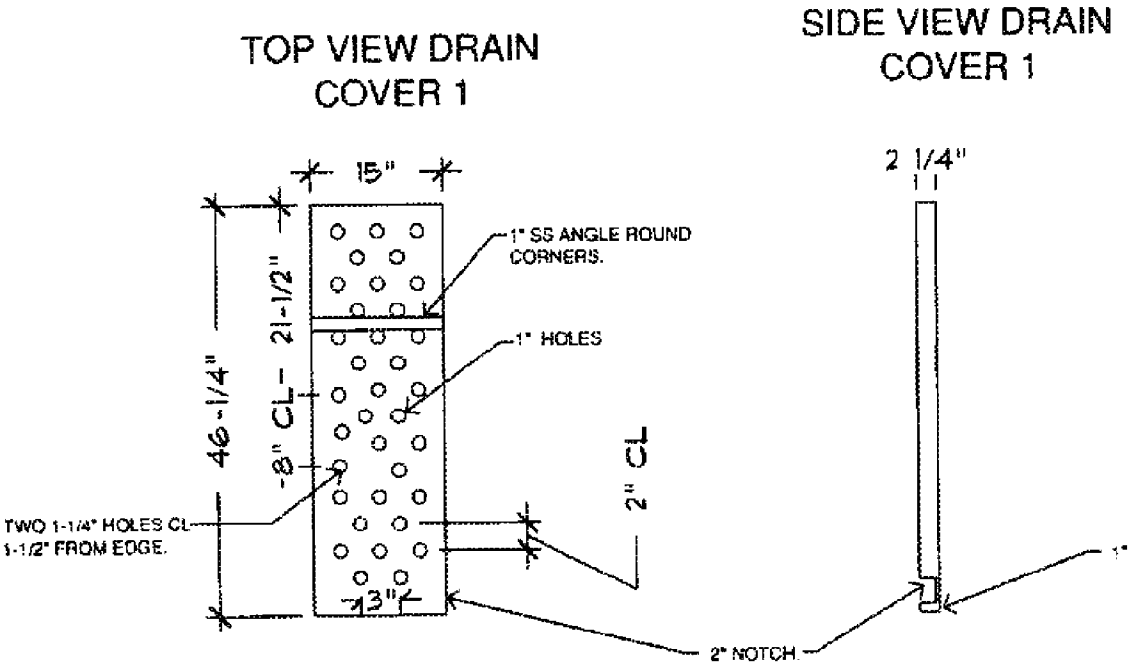

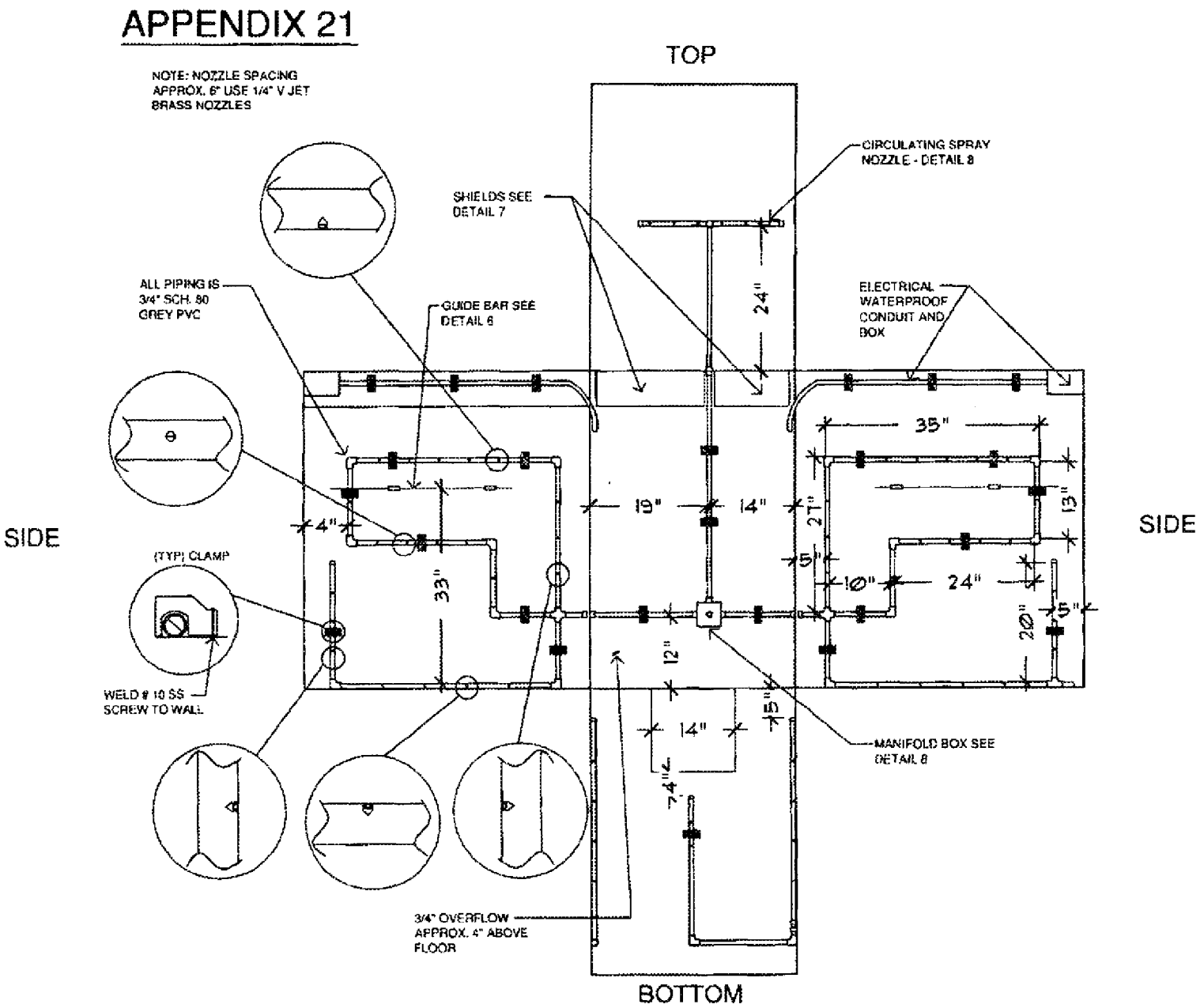
APPENDIX 21
NOTE: NOZZLE SPACING APPROX. 6" USE 1/4" V JET BRASS NOZZLES
SIDE
TOP
BOTTOM
SIDE
CIRCULATING SPRAY NOZZLE - DETAIL 8
ELECTRICAL WATERPROOF CONDUIT AND BOX
MANIFOLD BOX SEE DETAIL 8
SHIELDS SEE DETAIL 7
GUIDE BAR SEE DETAIL 6
3/4" OVERFLOW APPROX. 4" ABOVE FLOOR
ALL PIPING IS 3/4" SCH. 80 GREY PVC
(TYP) CLAMP
WELD # 10 SS SCREW TO WALL
35"
24"
20"
13"
5"
10"
21"
5"
24"
14"
19"
12"
14"
7"
10"
33"
4"

APPENDIX 22
BACK DOOR - VIEW ZZ
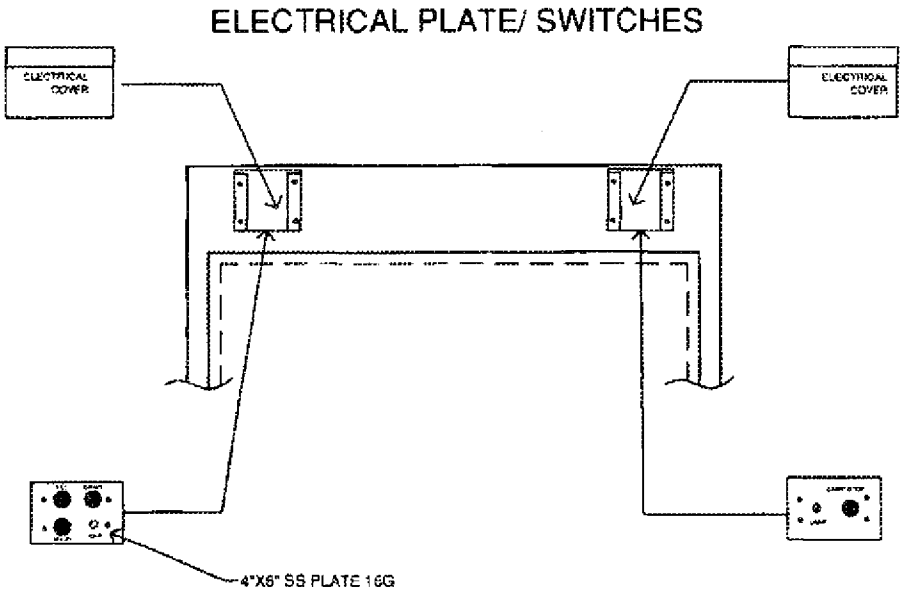

APPENDIX 23
ELECTRICAL COVER DETAIL 5
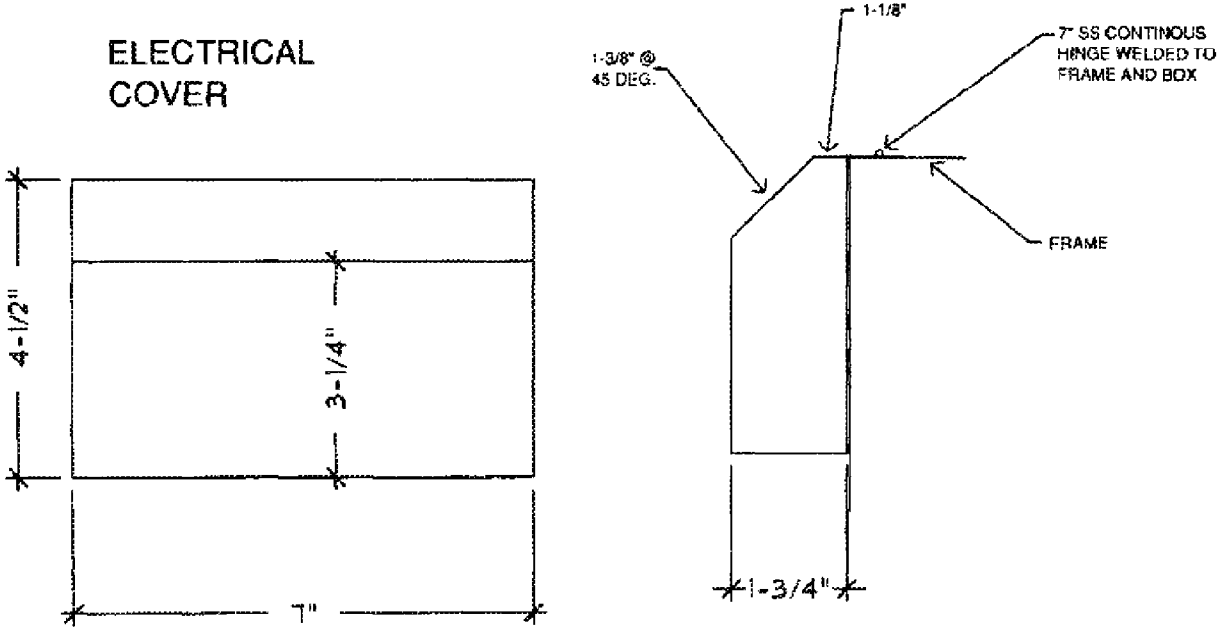

APPENDIX 24
PUMP SUCTION DETAIL
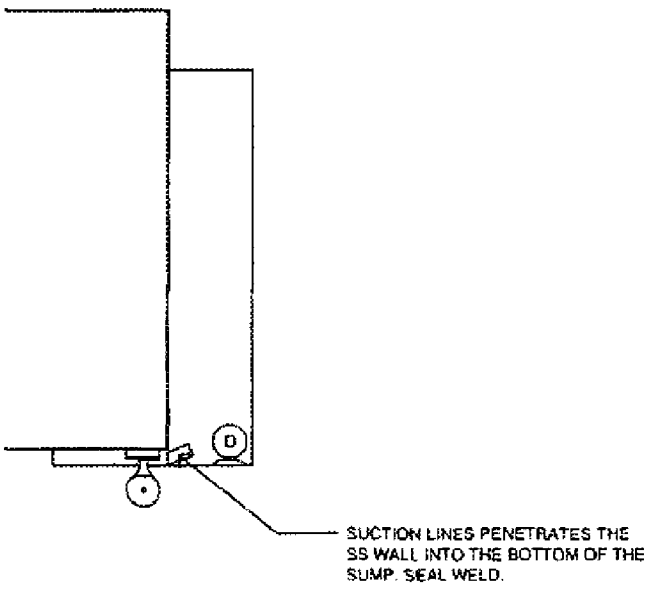
WELD 1-1/2" AND 3/4" SS SUCTION LINES FROM THE PAN TO THE SUCTION OF THE PUMPS. USE REINFORCED TUBING FOR JOINING PUMP AND SUCTION. ANGLE FROM PAN TO PUMP IS APPROX. 30 DEG.

APPENDIX 25
DETAIL 6
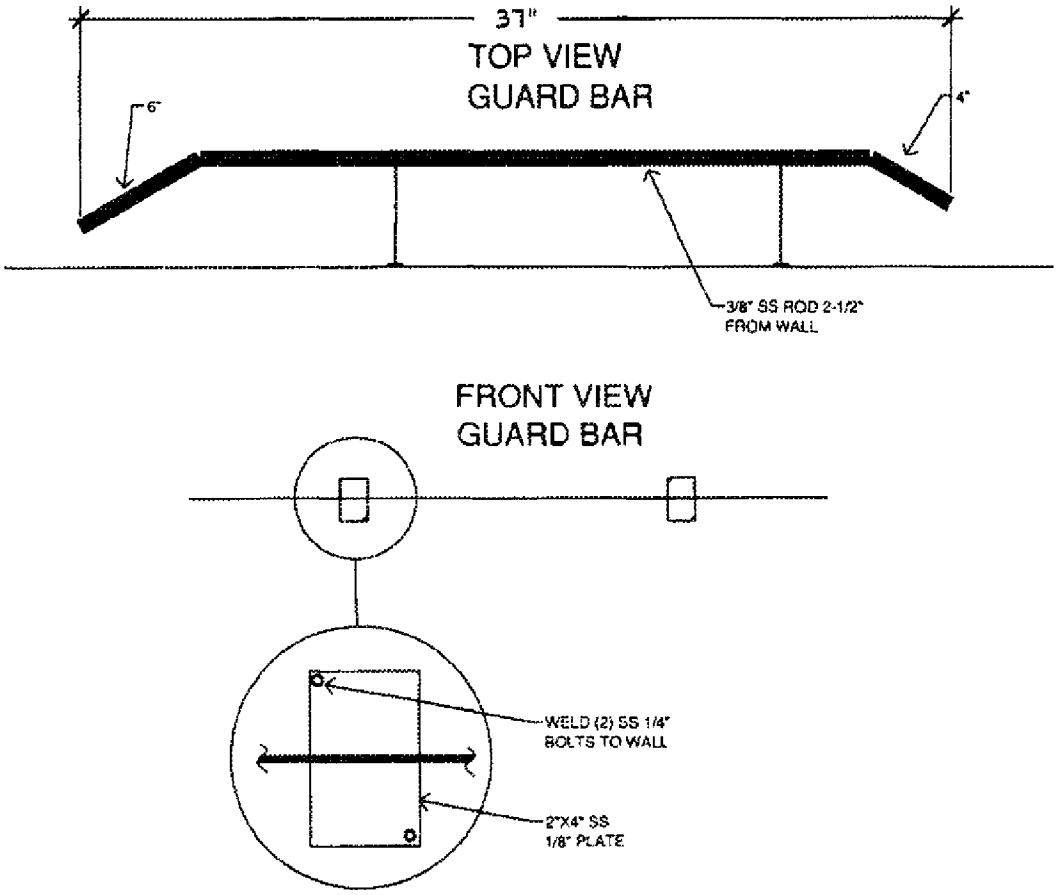

APPENDIX 26 SHIELDS SEE DETAIL 7
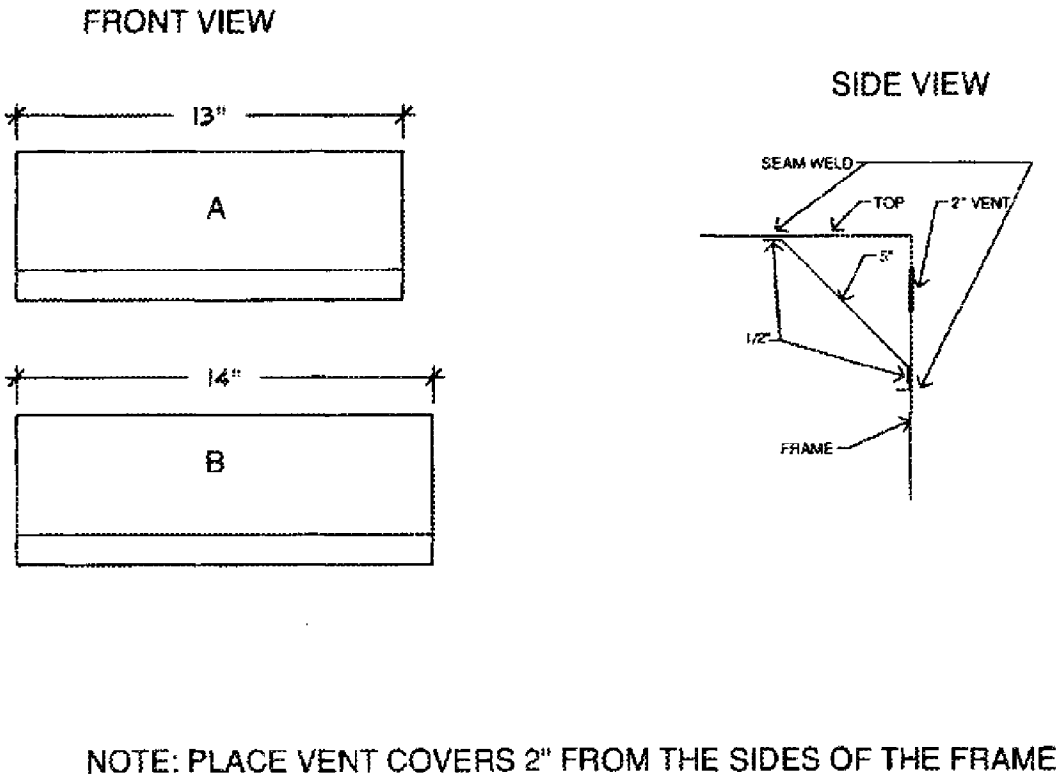
NOTE: PLACE VENT COVERS 2" FROM THE SIDES OF THE FRAME APPENDIX 27
WATER DISTRIBUTION BOX - DETAIL 8
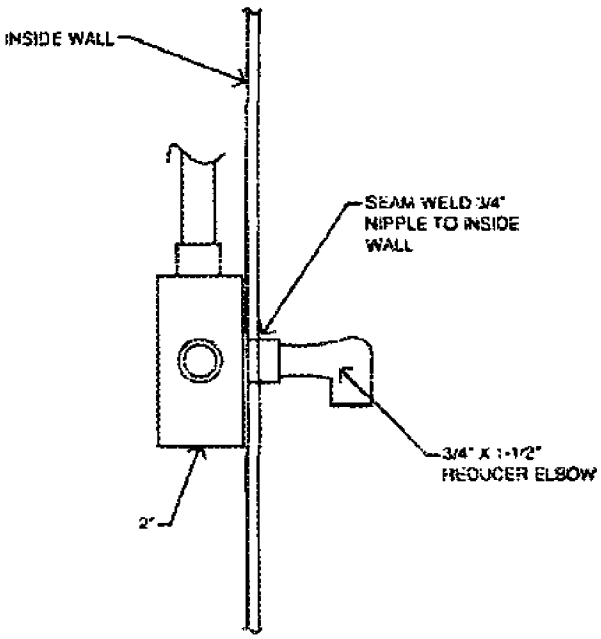
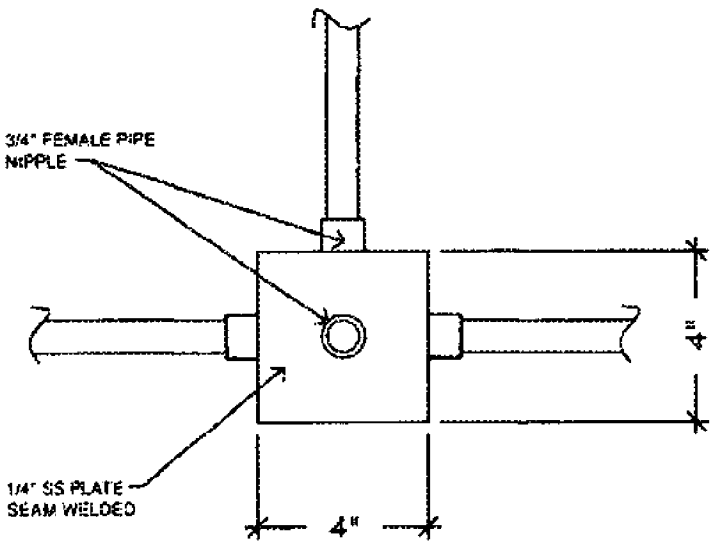

APPENDIX 28
DETAIL 9 SIDE VIEW
TOP OF CART
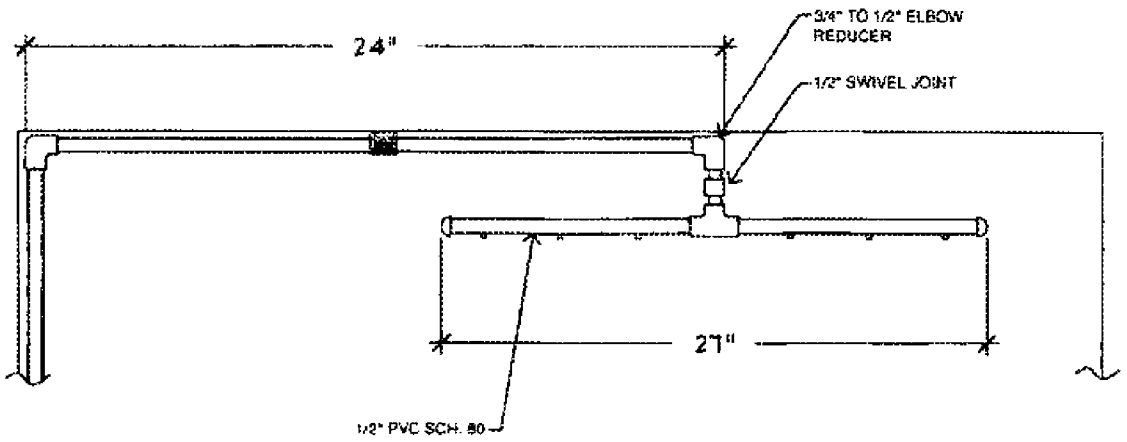
NOTE: (6) SPRAY NOZZLES DIRECTED DOWN
(2) NOZZLES DIRECTED HORIZONTALLY TO MAKE IT SPIN APPENDIX 29
PUMP PANEL DETAILS
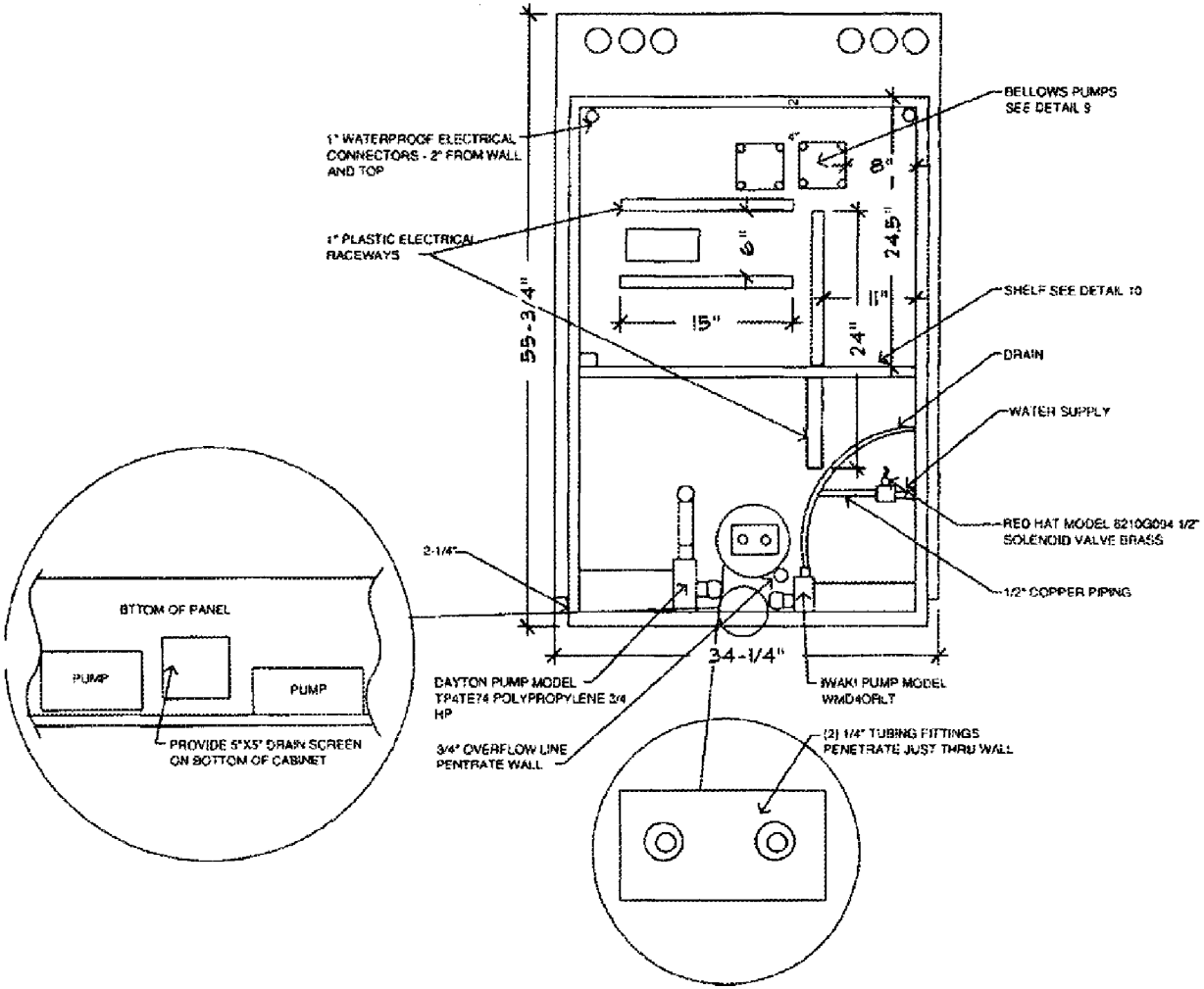

APPENDIX 30
SHELF DETAIL
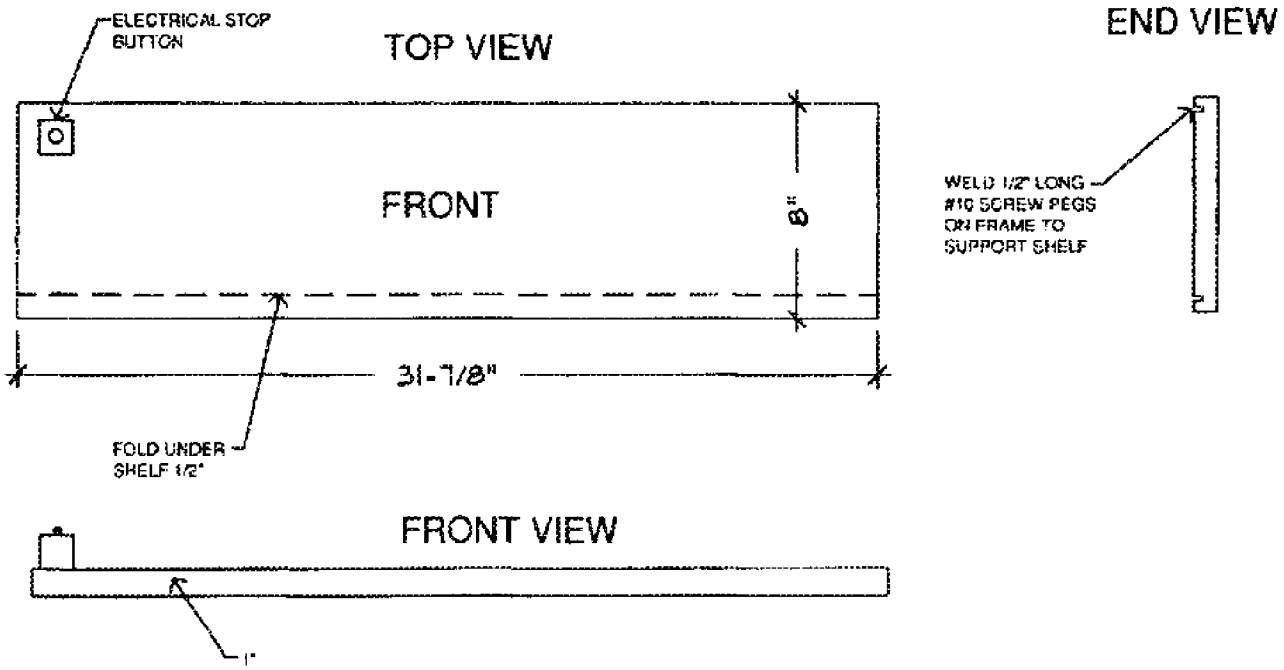

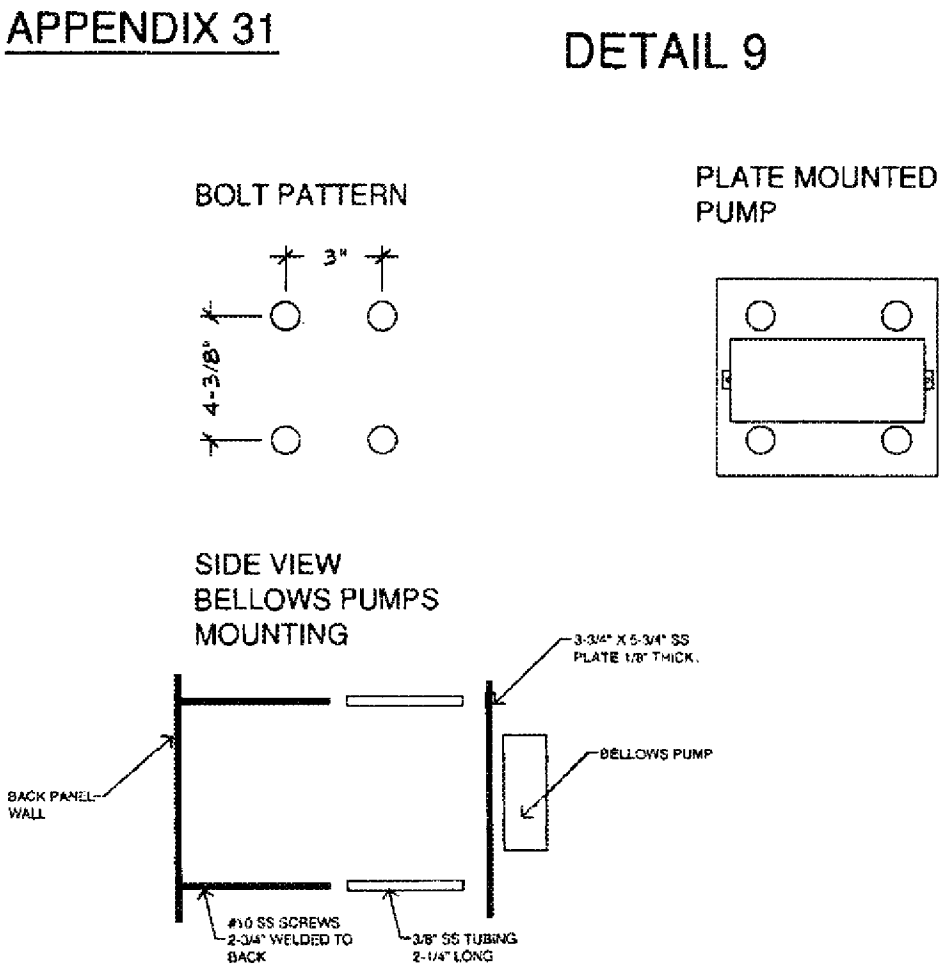
APPENDIX 31
DETAIL 9
BOLT PATTERN
3"
4-3/8"
PLATE MOUNTED PUMP
SIDE VIEW BELLOWS PUMPS MOUNTING
3-3/4" X 5-3/4" SS PLATE 1/8" THICK.
BELLOWS PUMP
3/8" SS TUBING 2-1/4" LONG
#10 SS SCREWS 2-3/4" WELDED TO BACK
BACK PANEL WALL APPENDIX 32
MOTOR END VIEW
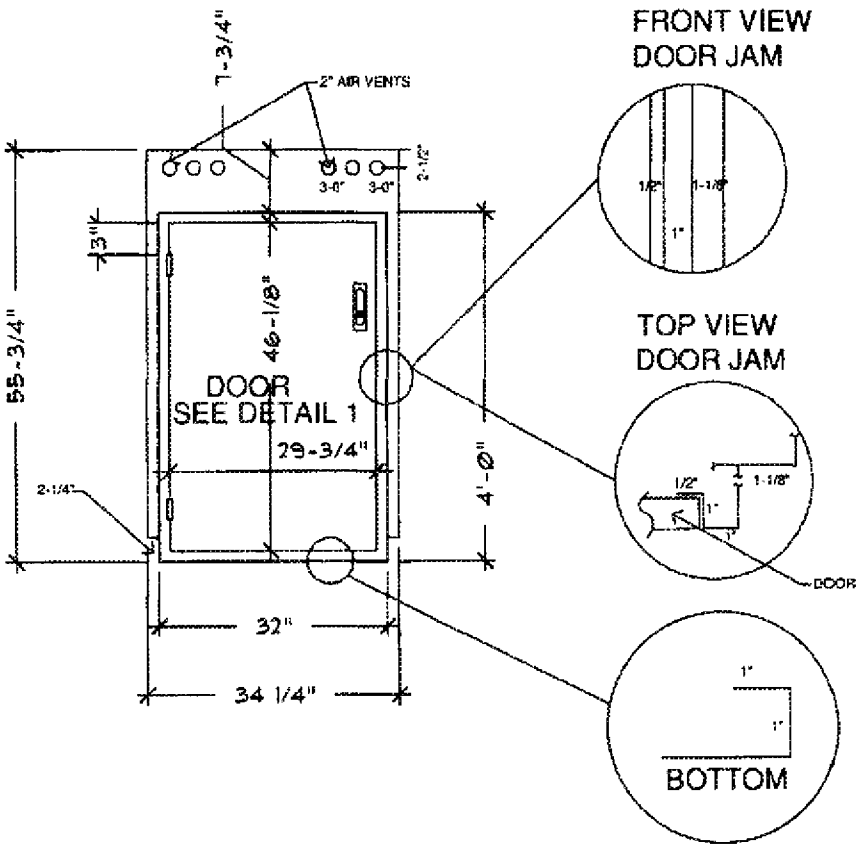

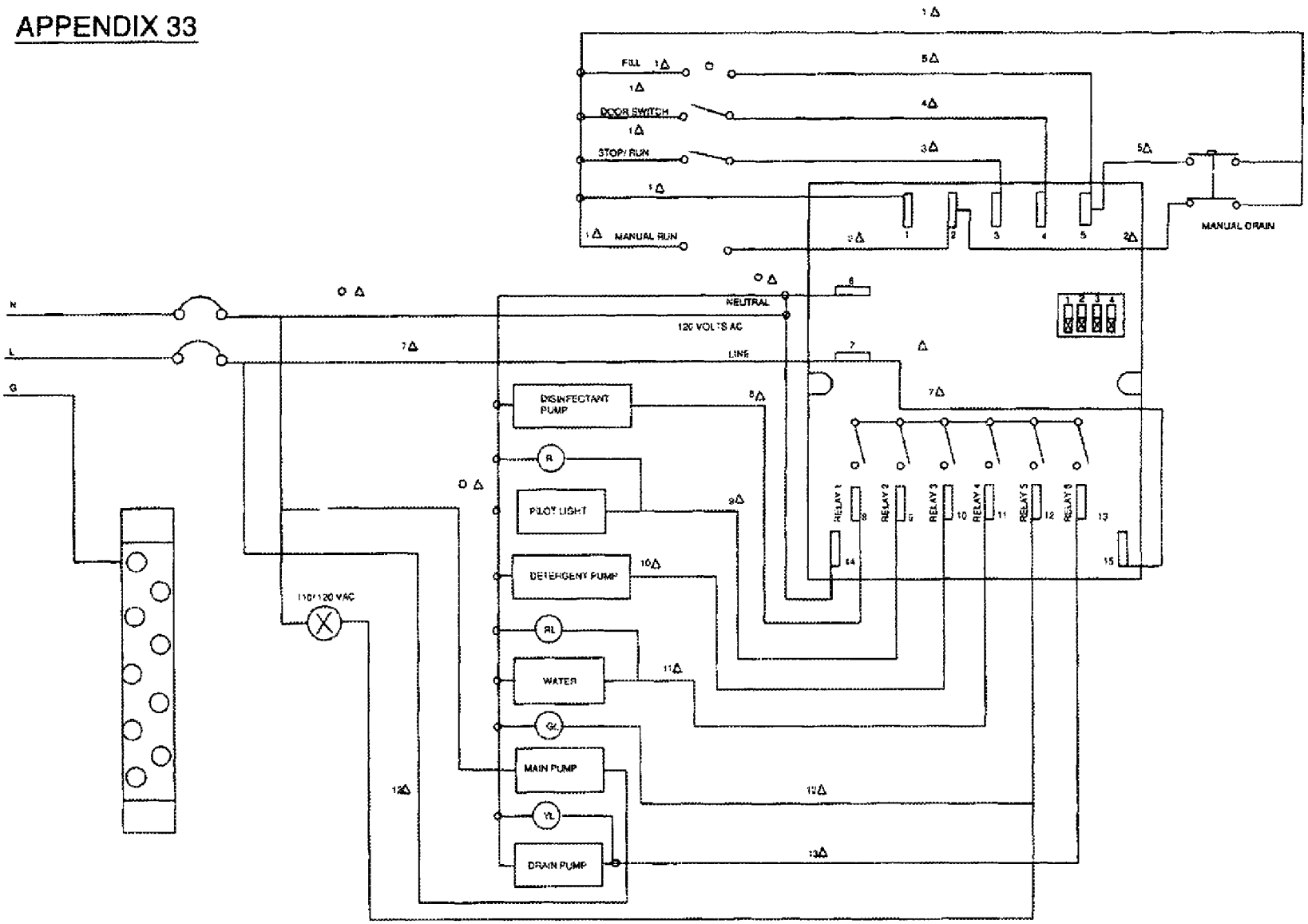
APPENDIX 33

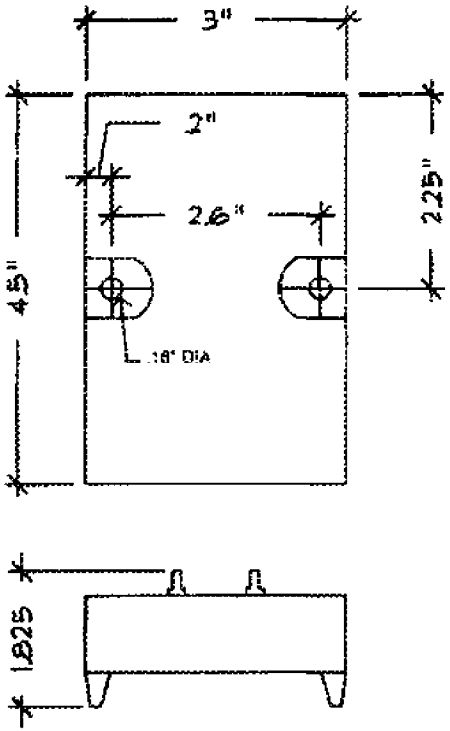

APPENDIX 34

SPECIFICATIONS:

INPUT VOLTAGE

VAC: 120 VAC
LINE VOLTAGE SHIFT TOLERANCE: +/- 10% OF LISTED NOMINAL
LINE FREQUENCY: 60 Hz

RELAY OUTPUT: (DRAIN PUMP)
LOAD CURRENT:
10 AMP RESISTIVE CONTINUOUS,
MOTOR LOAD - 1/6 HP

RELAY OUTPUT: (ALL OTHERS)
LOAD CURRENT:
3 AMP RESISTIVE CONTINUOUS,
MECHANICAL LIFE - 10,000,000 OPERATIONS
CONTACT LIFE - 100,000 OPERATIONS

TIMING MODE:
SEE MODE OF OPERATION

TIMING ACCURACY:
REPEATABILITY: +/- 20 M SEC
SWITCH DEBOUNCE TIME: 100 M SEC

TEMPERATURE RANGE:
OPERATING AMBIENT - 25°C TO +60 °C
STORAGE - 40 °C TO +85°C

NOISE IMMUNITY:
TESTED TO 2500 VOLTS EFT (ELECTRICALLY FAST TRANSIENT)

APPENDIX 35

DIP SWITCH TABLE WATER VALVE DURATION (SECONDS)

| | S1 | S2 | S3 | S4 | AUTO TIME TIME (SEC) | MANUAL RUN TIME (SEC) |
|---|---|---|---|---|---|---|
| 0 | OFF | OFF | OFF | OFF | INVALID | INVALID |
| 1 | ON | OFF | OFF | OFF | 35 | 10 |
| 2 | OFF | ON | OFF | OFF | 40 | 11 |
| 3 | ON | ON | OFF | OFF | 45 | 12 |
| 4 | OFF | OFF | ON | OFF | 50 | 13 |
| 5 | ON | OFF | ON | OFF | 55 | 14 |
| 6 | OFF | ON | ON | OFF | 60 | 15 |
| 7 | ON | ON | ON | OFF | 65 | 16 |
| 8 | OFF | OFF | OFF | ON | 70 | 17 |
| 9 | ON | OFF | OFF | ON | 75 | 18 |
| 10 | OFF | ON | OFF | ON | 80 | 19 |
| 11 | ON | ON | OFF | ON | 85 | 20 |
| 12 | OFF | OFF | ON | ON | 90 | 21 |
| 13 | ON | OFF | ON | ON | 95 | 22 |
| 14 | OFF | ON | ON | ON | 100 | 23 |
| 15 | ON | ON | ON | ON | 105 | 24 |

NOTE:

TO CHANGE DIP SWITCH SETTING:
TURN POWER OFF FOR A MINIMUM OF 2 SECONDS.
SET DIP SWITCH, THEN TURN POWER ON.
DIP SWITCH SETTINGS ARE RECOGNIZED AT POWER UP ONLY.

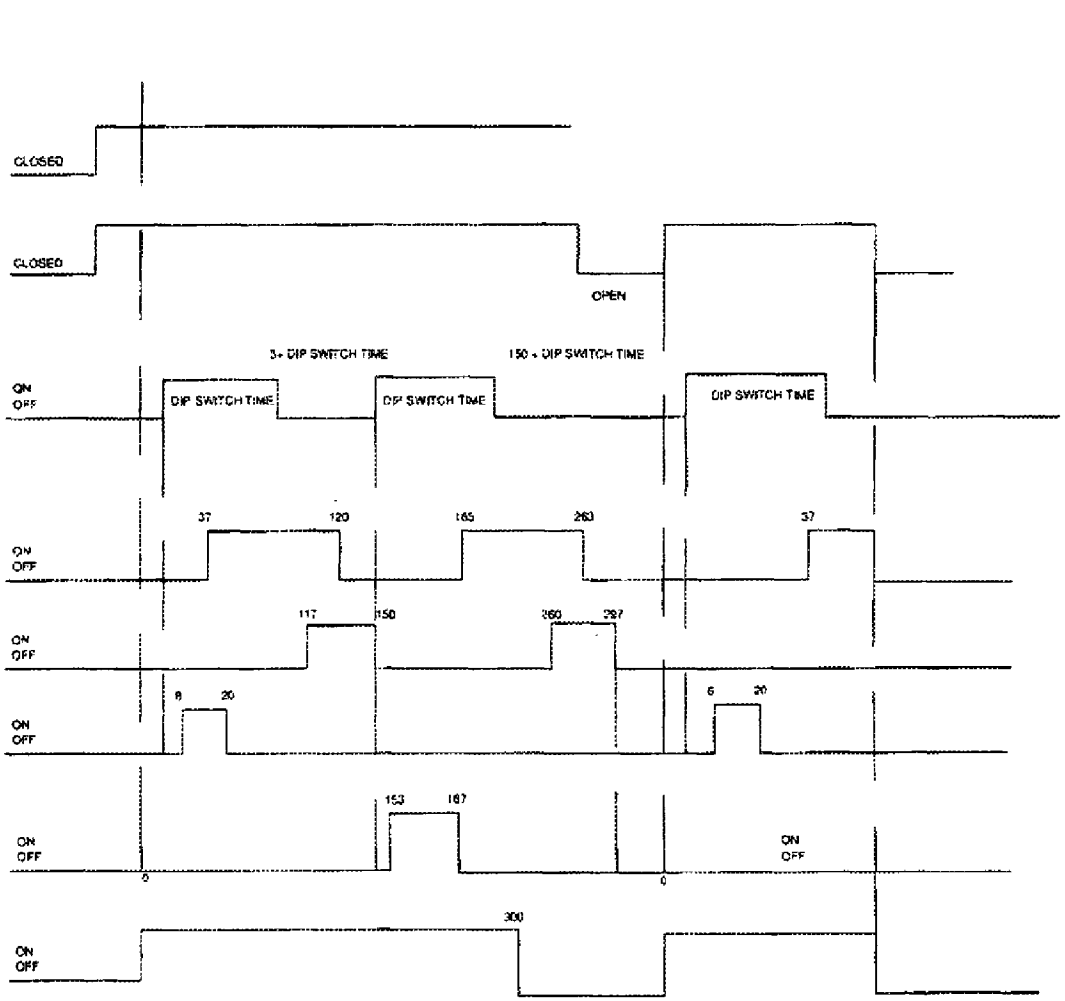

NOTES:
1. WHEN THE RUNSTOP SWITCH IS CLOSED, THE 300 SECOND SEQUENCE IS STARTED.
2. THE CYCLE COUNT STOPS AND ALL OUTPUTS ARE OFF, & KEEPT THE CYCLE LIGHT. IF THE DOOR SWITCH IS OPEN., THE CYCLE CONTINUES WHEN THE DOOR SWITCH IS CLOSED.
3. IF THE RUNSTOP SWITCH IS OPENED DURING THE 300 SECOND CYCLE, THE CONTROL IS RESET AND ALL OUTPUTS ARE OFF.
4. CLOSING THE MANUAL DRAIN SWITCH RUNS THE DRAIN PUMP UNTIL THE MANUAL DRAIN SWITCH IS OPEN.
5. WATER VALVE ON TIME IS CONTROLLED BY THE DIP SWITCH. START TIMES REMAIN AS SHOWN BUT DURATION IS SELECTED FROM 35 SECONDS TO 110 SECONDS IN 5 SECONDS INCREMENTS.

6.TO CHANGE DIP SWITCH SETTING:
TURN POWER OFF FOR A MINIMUM OF 2 SECONDS,
SET DIP SWITCH, THEN TURN POWER ON.
DIP SWITCH SETTINGS ARE RECOGNIZED AT POWER UP ONLY.